US006925905B2

(12) United States Patent
Brock

(10) Patent No.: US 6,925,905 B2
(45) **Date of Patent: *Aug. 9, 2005**

(54) ADJUSTABLE PEDAL APPARATUS

(75) Inventor: Robert D. Brock, Grand Haven, MI (US)

(73) Assignee: Grand Haven Stamped Products, Divison of JSJ Corporation, Grand Haven, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/609,988

(22) Filed: Jun. 30, 2003

(65) Prior Publication Data

US 2004/0003675 A1 Jan. 8, 2004

Related U.S. Application Data

(63) Continuation of application No. 09/820,012, filed on Mar. 28, 2001, now Pat. No. 6,619,155, which is a continuation-in-part of application No. 09/782,561, filed on Feb. 13, 2001, now Pat. No. 6,564,672.

(60) Provisional application No. 60/254,016, filed on Dec. 7, 2000, and provisional application No. 60/204,439, filed on May 15, 2000.

(51) Int. Cl.[7] ..... G05G 1/14

(52) U.S. Cl. ..... 74/512; 74/513; 74/560; 74/562

(58) Field of Search ..... 74/512, 513, 560, 74/514, 562

(56) References Cited

U.S. PATENT DOCUMENTS

| | | | |
|---|---|---|---|
| 2,585,688 | A | 2/1952 | Saulnier |
| 2,760,739 | A | 8/1956 | Reichert |
| 2,908,183 | A | 10/1959 | Giovanni |
| 3,151,499 | A | 10/1964 | Roe |
| 3,242,763 | A | 3/1966 | Buchwald |
| 3,301,088 | A | 1/1967 | White |
| 3,576,302 | A | 4/1971 | Palfreyman |
| 3,643,524 | A | 2/1972 | Herring |
| 3,643,525 | A | 2/1972 | Gibas |
| 3,691,868 | A | 9/1972 | Smith |
| 3,765,264 | A | 10/1973 | Bruhn, Jr. |
| 3,828,625 | A | 8/1974 | Bruhn, Jr. |
| 3,975,972 | A | 8/1976 | Muhleck |
| 4,353,430 | A | 10/1982 | Sjoqvist et al. |
| 4,470,570 | A | 9/1984 | Sakurai et al. |

(Continued)

FOREIGN PATENT DOCUMENTS

| | | |
|---|---|---|
| FR | 2739947 | 10/1995 |
| GB | 973638 | 10/1964 |

OTHER PUBLICATIONS

Encyclopedia Britannica, vol. 14, 1979, pp. 510–516.
Handbook of Tables for Applied Engineering Science, 2nd Edition, CRC Press, 1976, p. 687.

*Primary Examiner*—Vinh T. Luong
(74) *Attorney, Agent, or Firm*—Price, Heneveld, Cooper, DeWitt & Litton LLP

(57) ABSTRACT

A pedal-supporting apparatus includes a bracket support configured to pivotally support a brake pedal subassembly and an accelerator pedal subassembly. The brake pedal subassembly includes an upper section, a lower section, and an adjustment mechanism adjustably connecting the two sections. The adjustment mechanism includes a track defining a channel, and a follower having a flange-supported bearing shoe that slidably engages the channel. The bearing shoe includes partially-compressed resilient portions and crush ribs that provide a consistent and stable connection that takes up slack to prevent a sloppy connection. The shoe also facilitates manufacture and assembly of the arrangement.

14 Claims, 18 Drawing Sheets

U.S. PATENT DOCUMENTS 4,499,963 A 2/1985 Liston
4,640,248 A 2/1987 Stoltman
4,683,977 A 8/1987 Salmon
4,848,708 A 7/1989 Farrell et al.
4,870,871 A 10/1989 Ivan
4,875,385 A 10/1989 Sitrin
4,944,269 A 7/1990 Imoehl
4,958,607 A 9/1990 Lundberg
4,969,437 A 11/1990 Kolb
4,986,238 A 1/1991 Terazawa
4,989,474 A 2/1991 Cicotte et al.
5,010,782 A 4/1991 Asano et al.
5,056,742 A 10/1991 Sakurai
5,078,024 A 1/1992 Cicotte et al.
5,086,663 A 2/1992 Asano et al.
5,148,152 A 9/1992 Stueckle et al.
5,172,606 A 12/1992 Dzioba et al.
5,309,361 A 5/1994 Drott et al.
5,321,980 A 6/1994 Hering et al.
5,351,573 A 10/1994 Cicotte
5,460,061 A 10/1995 Redding et al.
5,632,183 A 5/1997 Rixon et al.
5,676,220 A 10/1997 Dapsi et al.
5,697,260 A 12/1997 Rixon et al.
5,722,302 A 3/1998 Rixon et al.
5,725,184 A 3/1998 Kang et al.
5,771,752 A 6/1998 Cicotte
5,819,593 A 10/1998 Rixon et al.
5,823,064 A 10/1998 Cicotte
5,839,326 A 11/1998 Song
5,890,399 A 4/1999 Rixon et al.
5,927,154 A 7/1999 Elton et al.
5,937,707 A 8/1999 Rixon et al.
5,964,125 A 10/1999 Rixon et al.
6,073,515 A 6/2000 Elton et al.
6,109,241 A 8/2000 Engelgau
6,173,625 B1 1/2001 McFarlane et al.
6,178,847 B1 1/2001 Willemsen et al.
6,189,409 B1 2/2001 Neag et al.
6,205,883 B1 3/2001 Bortolon
6,209,417 B1 4/2001 Munger et al.
6,237,565 B1 5/2001 Engelgau
6,247,381 B1 6/2001 Toelke et al.
6,289,763 B1 9/2001 Rixon et al.
6,293,584 B1 9/2001 Levine
6,315,451 B1 * 11/2001 Michioka et al. ..... 384/42
6,324,939 B1 12/2001 Cicotte
6,352,007 B1 3/2002 Zhang et al.
6,367,348 B1 4/2002 Toelke et al.
6,431,022 B1 8/2002 Cicotte
6,609,438 B1 * 8/2003 Bigham et al. ..... 74/560
2001/0002556 A1 6/2001 Rixon et al.
2001/0015111 A1 8/2001 Rixon et al.
2002/0002874 A1 1/2002 Burton et al.
2002/0053254 A1 5/2002 Rixon et al.
2002/0078786 A1 6/2002 Zhang et al.
2002/0083789 A1 7/2002 Sundaresan et al.
2002/0088299 A1 7/2002 Toelke et al.
2002/0088300 A1 7/2002 Allen et al.
2002/0092374 A1 7/2002 Johansson et al.
2003/0099414 A1 * 5/2003 Okabe et al. ..... 384/42

* cited by examiner

ADJUSTABLE PEDAL APPARATUS

CROSS-REFERENCE TO RELATED APPLICATIONS

This application is a continuation of application Ser. No. 09/820,012, filed Mar. 28, 2001, entitled ADJUSTABLE PEDAL APPARATUS now U.S. Pat. No. 6,619,155, which is continuation-in-part of co-assigned application Ser. No. 09/782,561, filed Feb. 13, 2001 now U.S. Pat. No. 6,564,672, entitled ADJUSTABLE PEDAL APPARATUS, which in turn claims benefit of provisional applications filed under 37 C.F.R. 1.53(c), including provisional application Ser. No. 60/204,439, filed May 15, 2000, entitled ADJUSTABLE PEDAL APPARATUS, and provisional application Ser. No. 60/254,016, filed Dec. 7, 2000, entitled ADJUSTABLE PEDAL APPARATUS WITH NON-LINEAR ADJUSTMENT PATH. This application is further related to co-assigned application Ser. No. 09/782,563, filed Feb. 13, 2001, entitled PEDAL WITH TONGUED CONNECTION FOR IMPROVED TORSIONAL STRENGTH.

BACKGROUND OF INVENTION

The present invention relates to under-dash pedal systems for vehicle control, and more particularly relates to adjustable foot pedals that are adjustable relative to a seated person in a vehicle for optimal positioning and function.

Adjustable foot pedal systems for control of vehicles are known. For example, see U.S. Pat. No. 3,828,625. However, improvements are desired to allow linear adjustment of the pedals so that a location of the pedals to the vehicle floor and to the driver can be more appropriately controlled. For example, it is desirable to adjust the pedals in a manner that is most similar to adjusting a vehicle seat, since linearly adjusting a vehicle seat relative to foot pedals is widely accepted by the public and government regulators. However, a problem may result if the pedals are linearly adjusted, because with conventional thinking, this requires that the actuators (e.g. push rods, cables, and mechanical linkages) connecting the pedals to the associated vehicle components (e.g. a master brake cylinder, an engine throttle, or a clutch) be lengthened or shortened as the pedals are adjusted. Some designers are hesitant to make a length of actuators adjustable because this can introduce play, wear, and reduced reliability into the actuator. Nonetheless, there are potential cost savings if foot pedals are made adjustable instead of a vehicle seat being adjustable on a floor pan of the vehicle.

Even if the above challenges are overcome, the adjustable pedal system must be able to meet certain functional criteria. For example, the braking pedal must be able to withstand significant loads and torsional stress that occurs during hard braking of the vehicle. Further, the accelerator and brake pedal systems should preferably position the accelerator pedal and the brake pedal at the same relative positions after an adjustment, so that the driver does not mis-hit or have other problems when quickly switching from one pedal to the other. At the same time, the accelerator and brake pedal systems must be relatively simple, reliable, and very durable for long use. Another problem is caused by horizontally/rearwardly extending and protruding objects. It is undesirable to incorporate such protruding objects under an instrument panel or dash, especially in a relatively low position, where they can cause leg and knee injury during a vehicle crash. Also, there is not much room under an instrument panel, such that any pedal system must take up a minimum of space.

It is noted that vehicle brake pedals undergo a high number of low-stress cycles of use during normal braking, and further periodically undergo a significant number of high stress incidents, such as during emergency braking. Historically, loose joints and wear were not a problem, since stiff brake pedal levers were simply pivoted to a durable vehicle-attached bracket by a high-strength lubricious pivot pin. However, adjustable pedal systems have introduced additional joints and points of potential durability problems, as discussed below.

It is further noted that one reason that many vehicle manufacturers are now considering adjustable foot pedals is because there are advantages of improved air bag safety and lower cost to adjusting the location of pedals instead of moving a steering column, vehicle seat, and/or occupant. However, this has introduced joints and components into the brake pedal system that were not previously present. For example, in an adjustable pedal system where a linear adjustment device is introduced between the pedal lever and the pedal pivot, the adjustment device must be made of a first track component attached to the pedal lever and a second track component attached to the pedal pivot, all of which must be attached and adjustably interconnected in a manner that does not become loose over time under either low-cycle high stress or high-cycle intermediate stress. Further, all components in the system must provide consistently high bending or torsional strength, despite dimensional and other manufacturing variations. At the same time, the joints must preferably be simple, low cost, reliable, effective, robust, and readily manufacturable.

One more subtle problem with existing adjustable pedals which are designed for linear travel is that while they are able to effectively withstand the forces applied directly for and aft when applying the brake, they are often relatively weak when a load or force is applied in a cross-car (side-to-side) direction. The pedals typically have excess and undesirable lash or looseness in the side-to-side direction and are subject to failure under relatively low loads. Further, they are subject to customer complaint and/or poor "feel" during use.

Additionally, due to the inability of current linear adjustment mechanisms to withstand lateral loading and high torsional loads, the pedal beams and pads must be located just under the adjustment mechanism with little offset side-to-side, so that minimal torque is applied to the adjustment mechanism. In today's vehicle designs, and in particular with smaller vehicles, there are often many obstructions under the vehicle dash, such as the steering column, and limited room for location of the adjustment mechanism. Therefore, there is often a need for the pedal beam and pad to be offset from the adjustment mechanism to fit into limited available space. This offset may put a large torsional load on the adjustment mechanism, which must have the ability to resist the load without chance of failure and without lash or looseness in the system. Additionally, to keep the loads and stresses to a minimum on the pedal adjustment mechanism, it is desirable in current linear adjustment systems to locate the adjustment mechanism as low as possible in the vehicle to reduce the moment arm and stress induced in the adjustment mechanism. This further places limitations on the flexibility of the system to package or fit in tight vehicle spaces under the dash.

The present inventive system is designed to overcome the problems described above and which are experienced with existing adjustable pedal systems. Because of the unique channel design, it is able to resist very large lateral and torsional loads. The benefit of this is that the present inventive system has very little looseness or lash. It can easily withstand large fore-aft and lateral loads with little deflection, looseness, or failure. Additionally, the pedal can be offset by as much as 70 mm in a side-to-side direction, which gives the vehicle designers great flexibility in designing a pedal system around the many obstructions in a vehicle, especially smaller vehicles. Another benefit of the present inventive system, is that the adjustment mechanism can be located relatively high in the pedal support bracket as the system is able to withstand the high loading resulting from a long pedal beam or from the large torsional loading condition. This provides great flexibility for packaging in the vehicle.

One problem typical with many adjustable pedal systems, is that the loads or forces applied to the pedals, are transferred through and resisted by the adjustment mechanism drive gears. Ideally, the adjustment mechanism gears would be designed for the sole purpose of moving the pedal in the fore-aft positions and would not take a lot of load from the application of the pedal. They could then be designed small and very economically. But when the adjustment mechanism gears must also be designed to resist the forces applied on the pedal, they must be designed large and strong enough to withstand tremendous loads that are applied to the pedal. This will add cost and complexity to the gears and will create a condition where they are subject to failure or unnecessary wear.

There are at least two types of pedal systems. One is a pivoting system which adjusts the fore-aft position of the pedal by rotation of the pedal around a pivot in the pedal support bracket. Because of the relatively short radius of the arc or radius of travel (typically 225–325 mm), the pedal will change its height relative to the floor by as much as 20 mm when traveling a fore-aft distance of 75 mm as the pedal moves about the arc. Additionally, the angle of the pedal can change as much as 12–15 degrees. Although this type of system may be relatively small and easy to package in a vehicle environment, the large change in height of the pedal relative to the floor, and the large change in angle of the pedal pad, may cause confusion of the driver or undesirable positioning of the foot on the pedal.

Another type of system adjusts the pedal linearly. An adjustable pedal system, which adjusts the pedal position in a linear fashion, can move in the fore-aft direction a distance of 75 mm with no change in height relative of the pedal to the floor, if desired. This is clearly an advantage to the designers of a vehicle as the pedal travel can be designed for optimum comfort and ergonomics of the driver. Unfortunately, these systems require a large adjustment mechanism, which is often difficult to fit or package in many vehicles. Further, such systems include components elongated in a rearward horizontal direction toward a vehicle drive, which can be undesirable.

The inventive adjustable pedal systems described below include a track and follower, and further include polymeric bearing shoes therebetween to provide a smooth sliding motion. Because of the high torsional stresses on these pedals, particularly on brake pedals, it is difficult to design a low cost solid bearing that is sufficiently tight to not be sloppy, yet that is able to be assembled easily. Further, the bearing shoe should not wear and become sloppy over time, even under high stress and/or high cycle use. Further, it is desirable that the present bearing provide a consistent low level of friction to help keep the pedal in an adjusted position, so that other components do not absorb all of this stress.

Accordingly, an apparatus solving the aforementioned problems and having the aforementioned advantages is desired.

SUMMARY OF THE INVENTION

In one aspect of the present invention, an adjustable pedal apparatus includes a support configured for attachment to a vehicle, and a pedal-supporting subassembly with an upper portion pivotally engaging the support, a lower portion supporting a pedal construction, and a track adjustment mechanism connecting the upper and lower portions. The track adjustment mechanism includes a track defining at least one guide channel extending horizontally, and a follower slidably engaging the track. The follower includes a bearing shoe made of bearing material that is located in and slidably engages the channel. The bearing shoe includes a body and a resilient portion spaced from the body and engaging the track located in the channel. The resilient portion is flexed and at least partially compressed so that the bearing shoe takes up any slack and sloppiness between the track and follower. The apparatus also includes an adjuster for adjusting the pedal construction along the track mechanism, and an actuator coupled to the pedal-supporting member and adapted for operative connection to a control system of a vehicle for operating the control system when the pedal-supporting member is moved.

These and other features, advantages, and objects of the present invention will be further understood and appreciated by those skilled in the art by reference to the following specification, claims, and appended drawings.

DETAILED DESCRIPTION OF PREFERRED EMBODIMENT

Figure 1:
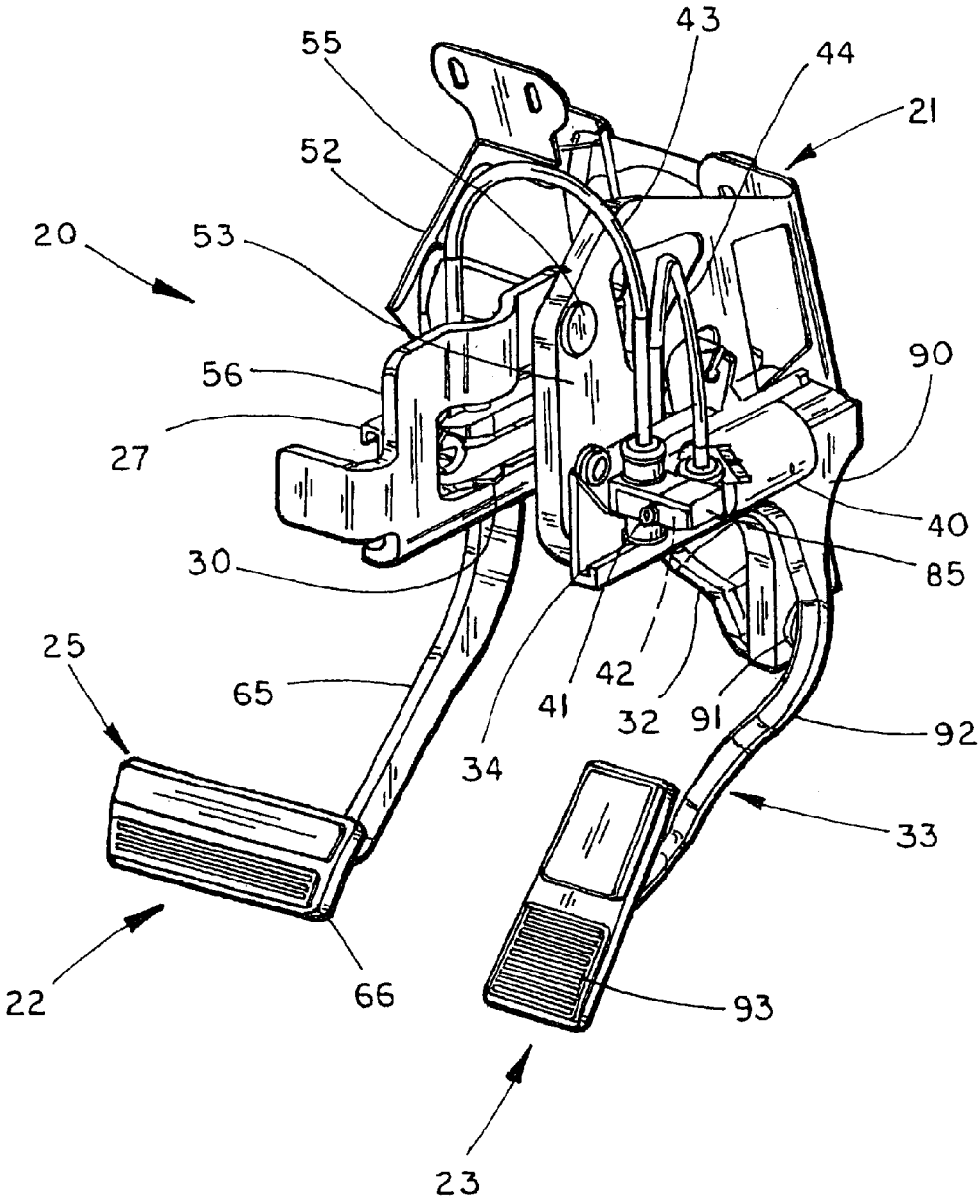
FIG. 1 is a front top perspective of an adjustable pedal apparatus embodying the present invention.
Figure 2:
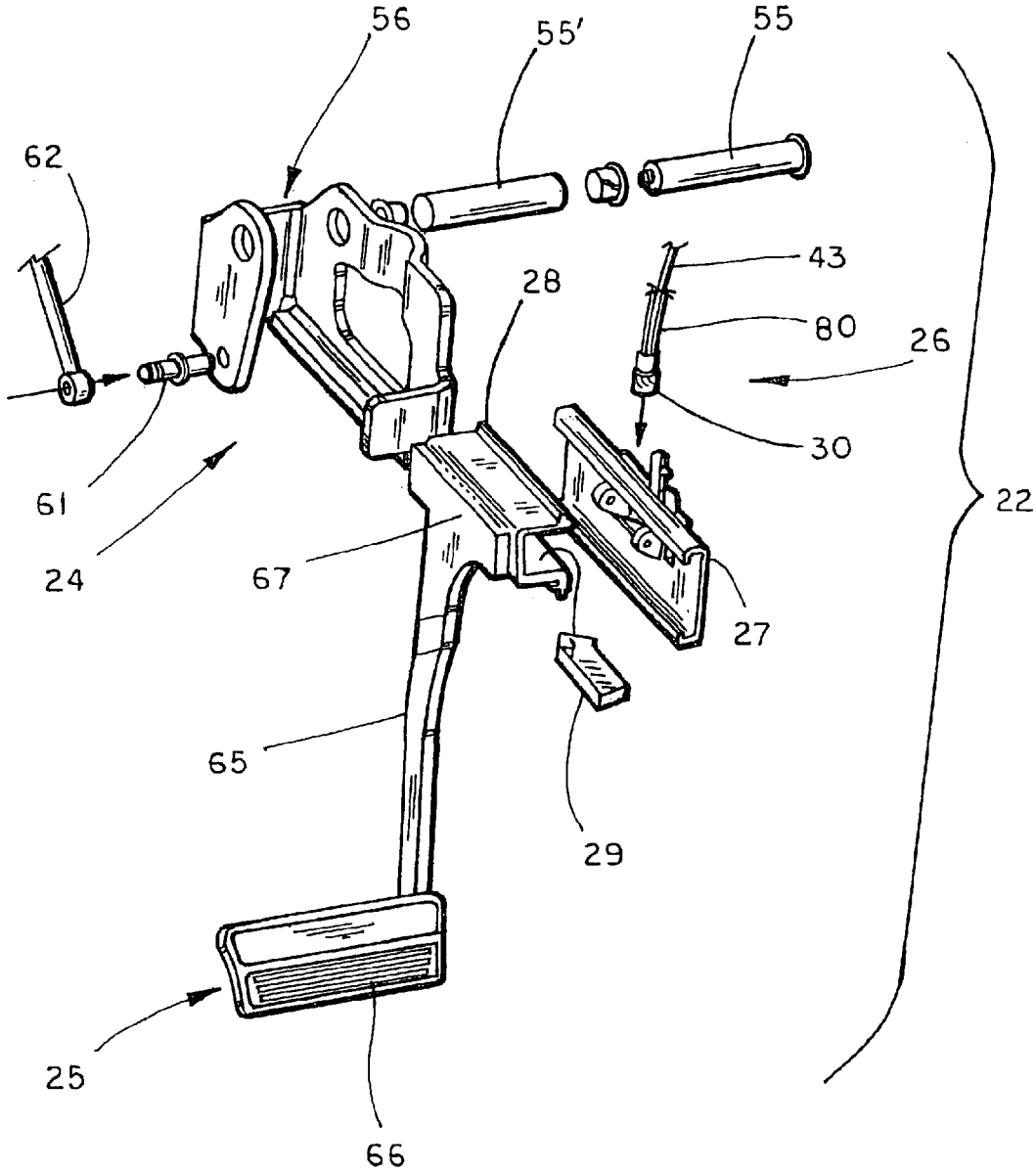
FIG. 2 is an exploded perspective view of the brake pedal subassembly shown in FIG. 1.
Figure 3:
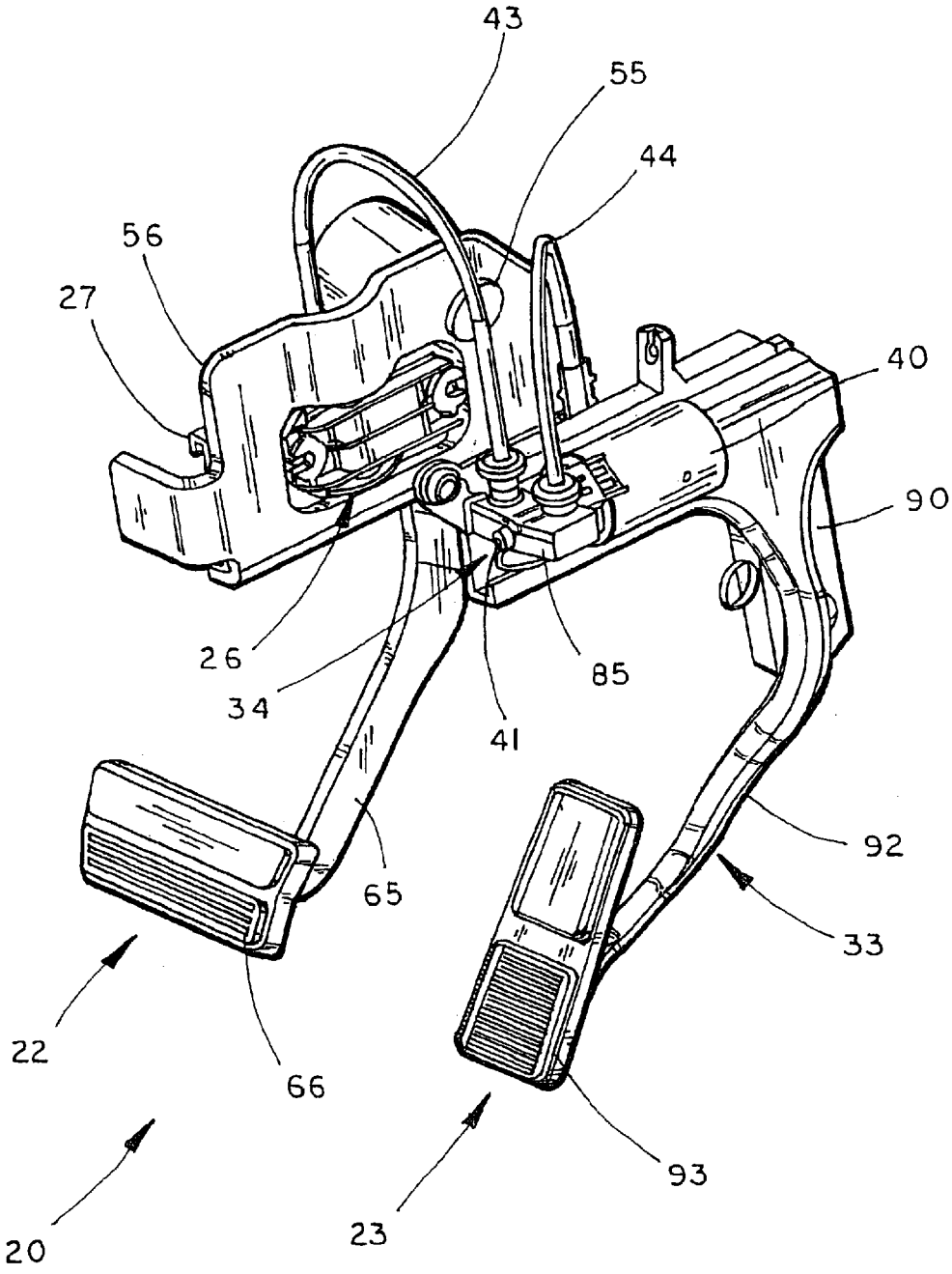
FIG. 3 is a front perspective view of the brake pedal subassembly and the accelerator pedal subassembly shown in FIG. 1.
Figure 4:
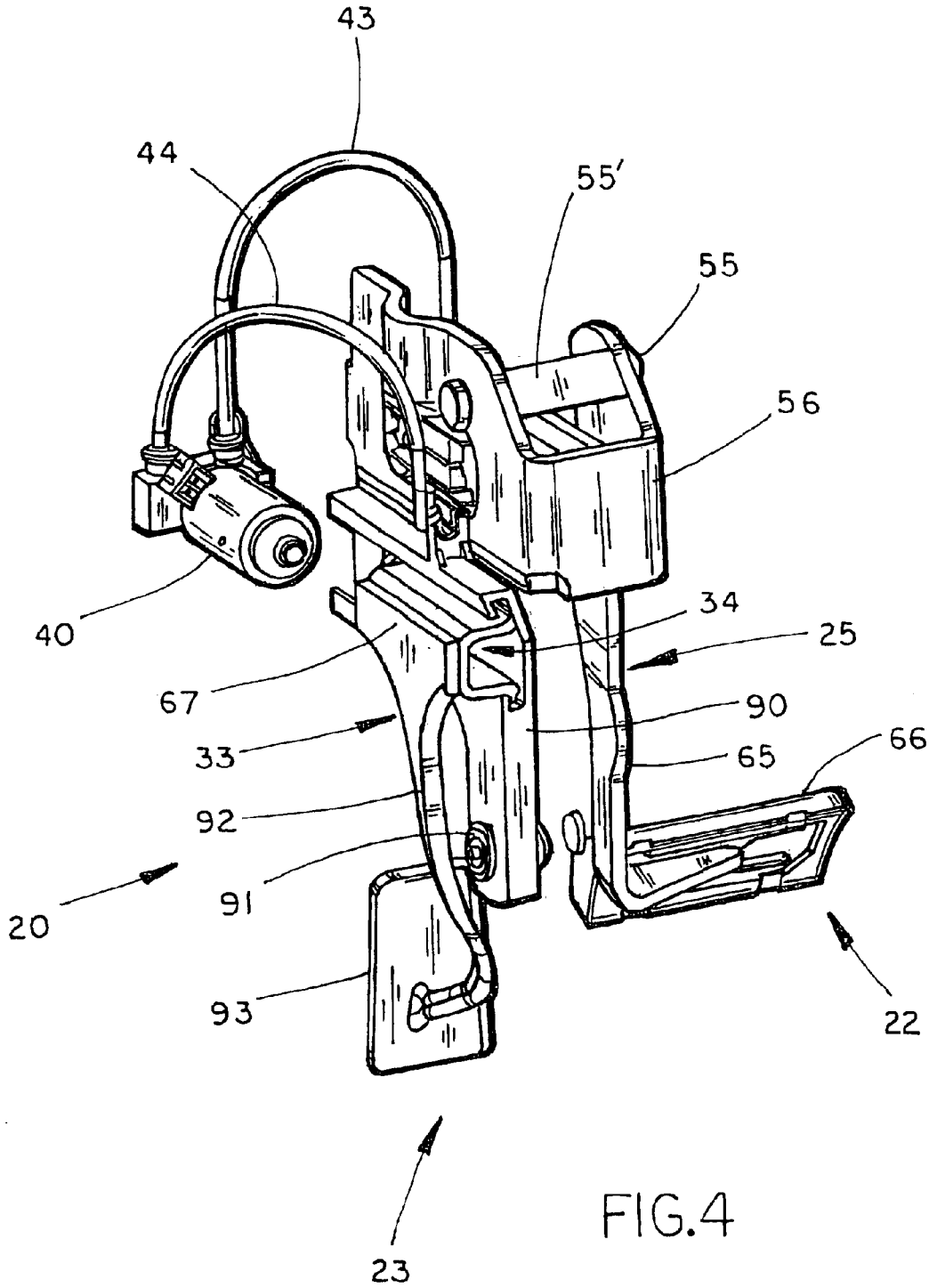
FIG. 4 is a rear perspective view of the apparatus shown in FIG. 3, the mounting bracket of the accelerator pedal subassembly being removed to more clearly show the underlying components.
Figure 5:
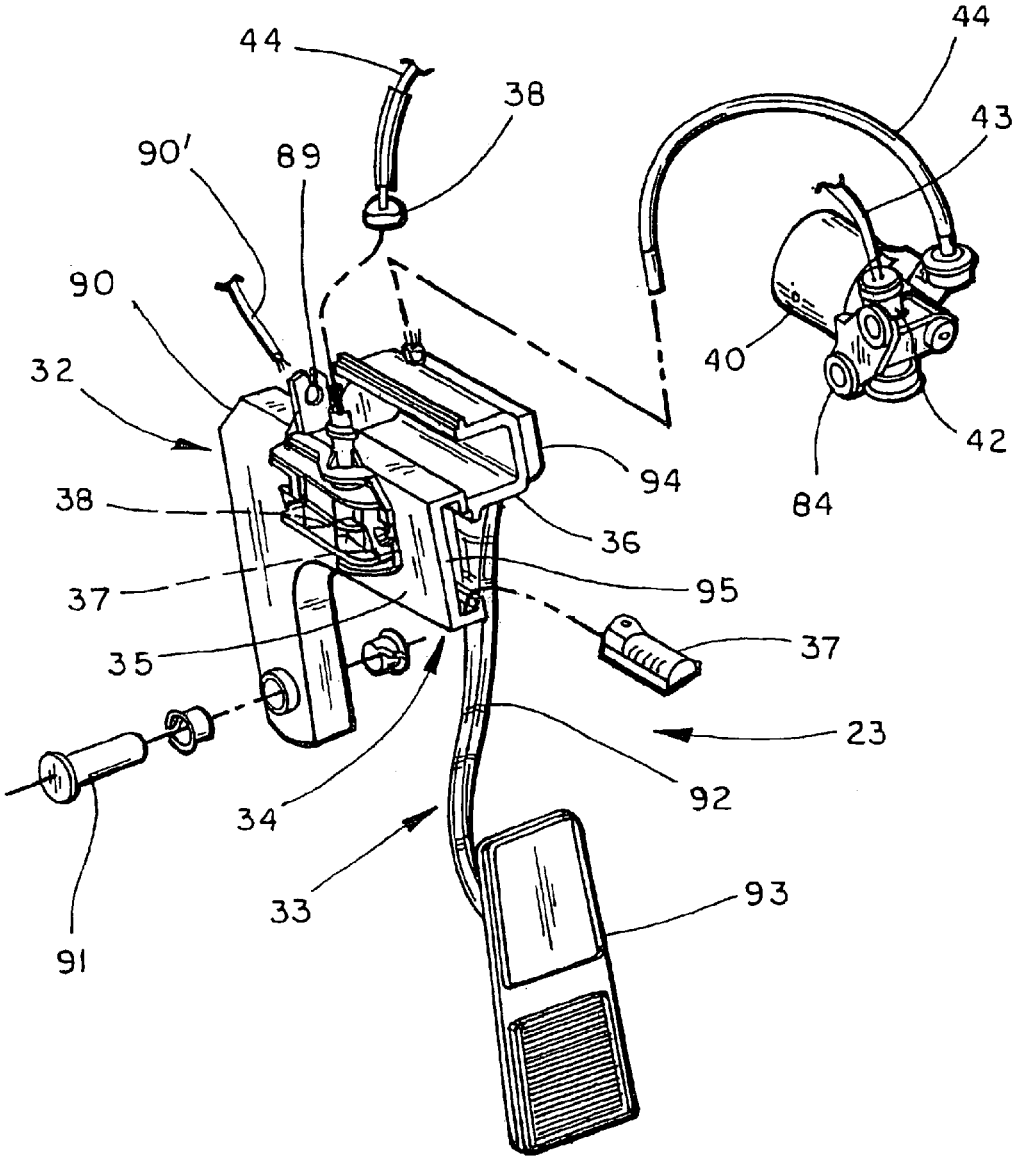
FIG. 5 is an exploded perspective view of the accelerator pedal subassembly shown in FIG. 4.
Figure 7:
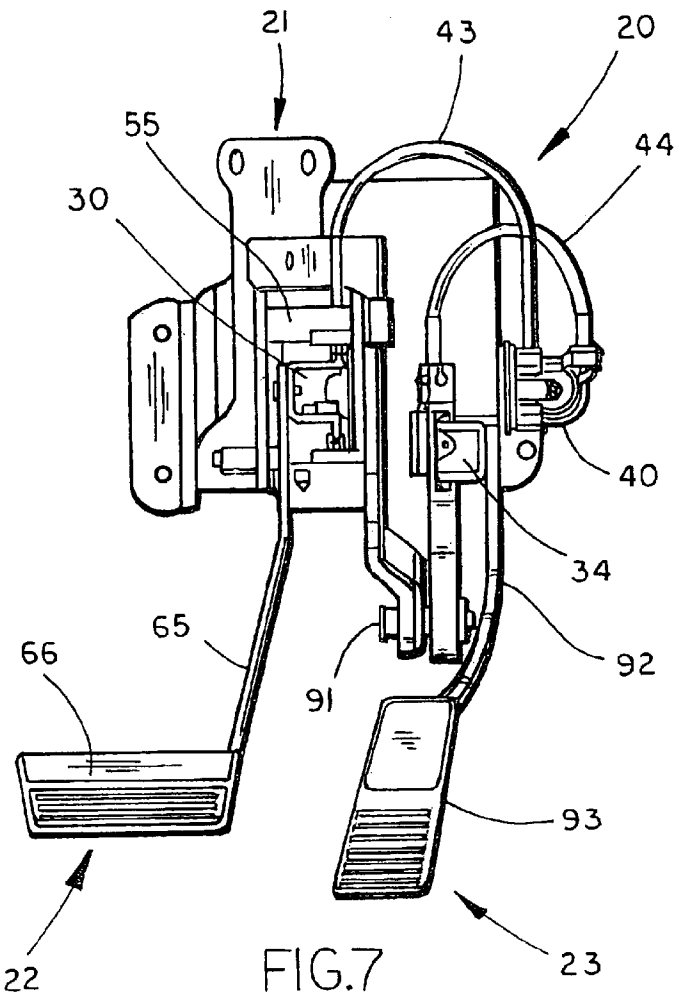
FIGS. 6–9 are right side, front, left side, and top views of the apparatus shown in FIG. 1.
Figure 10:
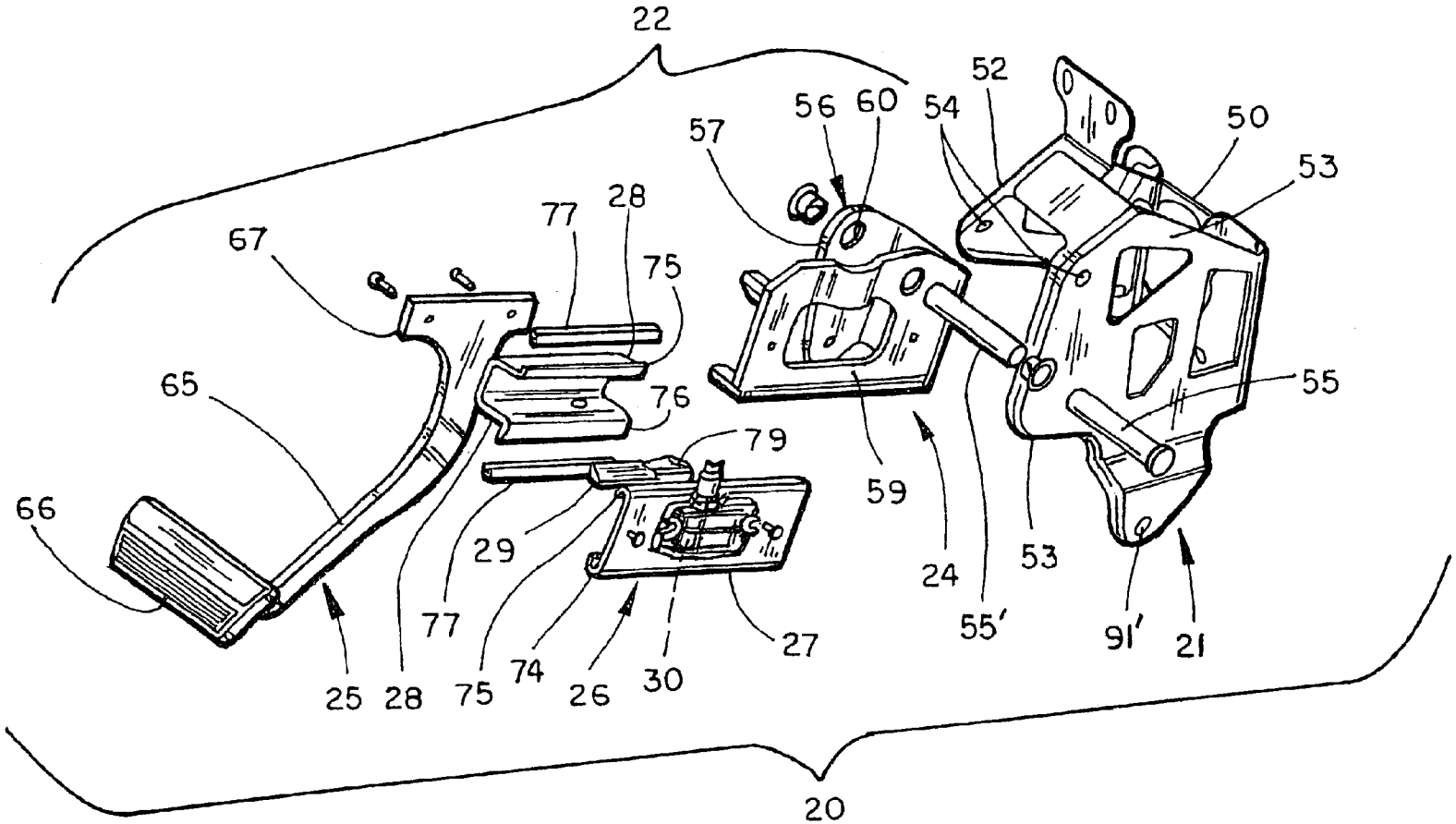
FIG. 10 is an exploded perspective view of the apparatus shown in FIG. 2, but including the support adapted to engage a vehicle firewall.

A pedal-supporting apparatus 20 (FIG. 1) includes a support 21 configured for attachment to a vehicle firewall under the vehicle's instrument panel, and a brake pedal subassembly 22 and an accelerator pedal subassembly 23 separately pivoted to the support 21. (Note: The support 21 could be configured in more than one piece, for example, the brake could be on one support and the accelerator on a support separate from the brake support.) The brake pedal subassembly 22 (FIG. 2) includes a brake-pedal-supporting upper portion 24 pivotally engaging the support 21, and a brake pedal lower portion 25 coupled to the brake-pedal-supporting upper portion 24 by a linear adjustment device 26 comprising a C-shaped linear track or channel 27 and a follower 28 with blade-shaped edges for operably engaging the track 27. A rack 29 (FIG. 10) adjacent and along the track 27 is engaged by a worm gear 30 for adjusting the location of the brake pedal lower portion 25. The accelerator pedal subassembly 23 (FIG. 1) includes an accelerator-pedal-supporting upper portion 32 pivotally engaging the support 21, and an accelerator pedal lower portion 33 (FIG. 5) coupled to the accelerator-pedal-supporting member 32 by a second linear adjustment device 34 comprising a C-shaped track or channel 35 and a follower 36 with blade-shaped edges operably slidably engaging the channel 35. A second rack 37 on the track 35 is engaged by a second worm gear 38 for adjusting the location of the accelerator pedal 33. (The rack 37 and gear 38 are similar to rack 29 and gear 30 in FIG. 10.) A reversible electric DC motor 40 includes a rotatable shaft 41 and a driving gear 42 on an end of the shaft 41. The driving gear 42 is operably engaged by driven gears on the end of cables 43 and 44. The cables 43 and 44 extend from the driven gears to the worm gears 30 and 38, respectively, so that the brake pedal lower portion 25 and accelerator pedal lower portion 33 are simultaneously and equally adjusted upon actuation of the motor 40. (Note: The motor could also be positioned and configured such that there is a direct connection between the motor and an adjustment device without the use of a cable.) This provides a reliable and yet relatively non-complex assembly that can withstand the wear and abuse associated with high use in service and that can withstand the occasional high stress during use, yet that can provide the structural and cost benefits of such a device.

With the present inventive system, there is little or no load that is transferred from the pedal into the drive gears. When a force is applied to the pedal, the force is transferred directly into the follower, which rotates in the track. This rotation locks the follower in the track and the load applied to the pedal is resisted by the track itself, thus eliminating a transfer of high loads to the gears. The gears can then be designed smaller and much more economically. A wider range of material options is then available for the gears including the use of plastic gears. Since the gears can be designed smaller and with a wider selection of materials, it is typically less expensive, more robust, and the system can then be optimized for low noise, which is a key requirement of most automotive companies.

Figure 6:
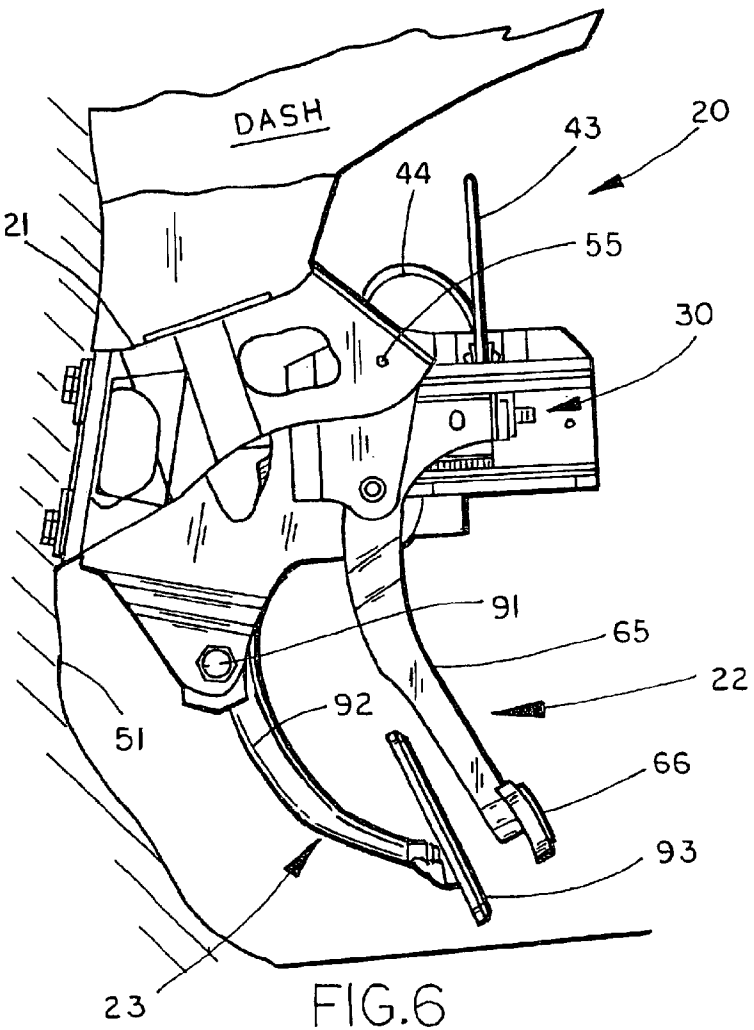
Figure 9:
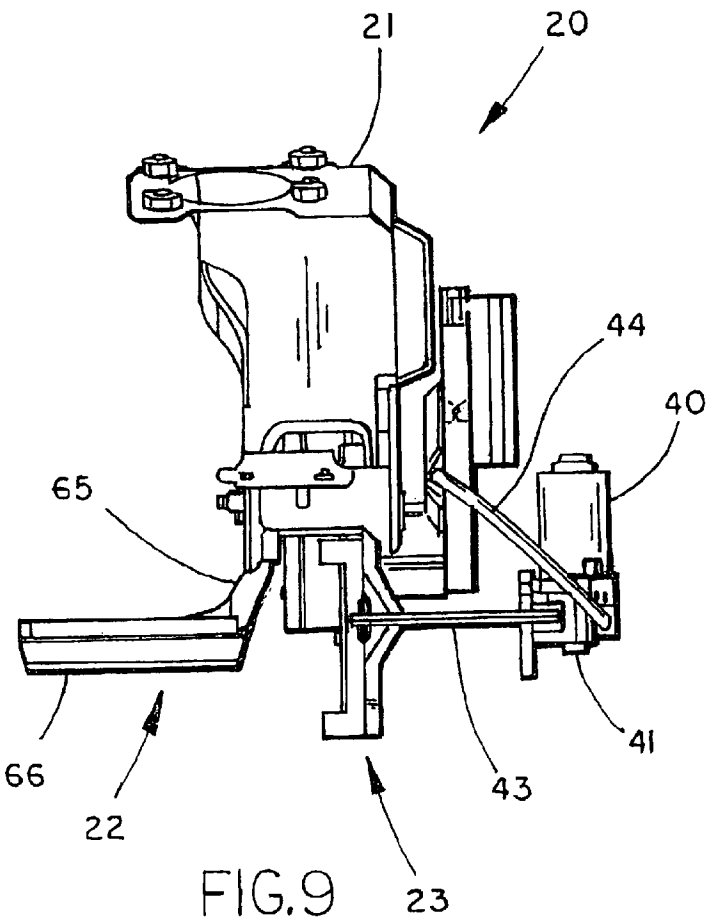
Figure 8:
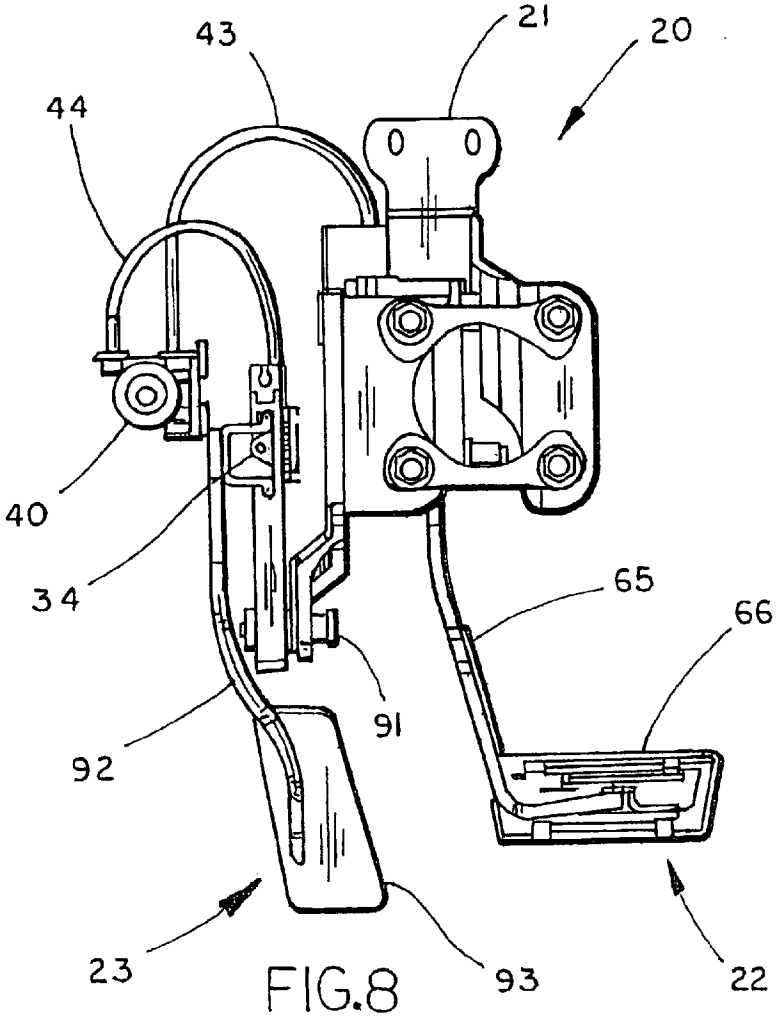

The support 21 (FIG. 10) includes a wall section 50 with flanges configured for secure connection to a vehicle firewall 51 (FIG. 6). (It is also contemplated that the support 21 could be attached to the vehicle instrument panel or dash module.) A pair of wall sections 52 and 53 (FIG. 10) extend forwardly from wall section 50 and include reinforcement ribs and flanges as needed for stiffening. Holes 54 are provided for receiving a pivot pin 55 for pivoting the brake pedal subassembly 22 and holes 91 (FIG. 10) are provided for pivoting the accelerator pedal subassembly.

As noted above, the brake pedal subassembly 22 (FIG. 10) includes an upper portion 24 and a lower portion 25 slidably secured to the upper portion 24. The upper portion 24 includes a U-shaped bracket 56 having a rear flange 57 and side flanges 58 and 59. The side flanges 58 and 59 fit mateably between the wall sections 52 and 53, and include holes 60 for receiving pivot pin 55 to pivotally mount the brake pedal subassembly 22 to the support 21. A connector 61 (FIG. 2) pivotally connects a push rod 62 to the mounting bracket 56. The push rod 62 is configured to be coupled to a master brake cylinder of a vehicle braking system in a manner known in the art, such that a detailed description of that aspect is not necessary for an understanding of the present invention. Notably, linear adjustment of the lower portion 25 of the brake pedal subassembly 22 on the upper portion 24 does not affect the position or operation of the push rod 62, which is a significant advantage in this adjustable system.

The lower portion 25 of the brake pedal subassembly 22 (FIG. 10) includes a structural arm 65 and a foot pedal pad 66 attached to a lower end of the arm 65. An upper end of the structural arm 65 is T-shaped, and includes an elongated top bracket 67.

The lower portion 25 is linearly slidably and adjustably connected to the upper portion 24 with a linear adjustment mechanism 26 (sometimes called an "adjustment device") that includes the hat-shaped channel 28 (sometimes called a "follower" herein) secured to the top bracket 67, and the C-shaped channel 27 (sometimes called a "guide" or "track") secured to the side flange 59 of the bracket 56. Notably, the illustrated channel 27 is C-shaped, but it is contemplated that other shapes are possible. The C-shaped channel 27 is vertically elongated for beam strength (which is required to withstand a vehicle driver pressing hard on the foot pedal pad 66), and includes top and bottom flanges 73 and 74 that stiffen the channel 27 and that form a concave region defining a track. The hat-shaped channel 28 includes opposing edges 75 and 76 defining a blade-shaped feature that mateably slidably engages the concave region (i.e. the track) defined by the C-shaped channel 27. Lubricious bearing material 77 is attached to the edges 75 and 76 for added long-term durability and for a constant coefficient of friction, if needed. Notably, some friction (i.e., a heightened level of static friction) may be desirable to stabilize the linear adjustment mechanism in an adjusted position. It would be desirable to create a level of static friction that would require a force of between 1 and 40 pounds to slide the follower in the track, preferably a force of between 5 and 20 pounds, and most preferably a force of between 8 and 15 pounds.

The rack 29 has a plurality of teeth and is attached to the hat-shaped channel 28 in a location where the teeth extend parallel the track of channel 27. At the end of the teeth on the rack 29 is a section of material 79 creating a stop for engaging the worm gear 30 in an abutting manner preventing binding. The worm gear 30 is operably attached to the C-shaped channel 27 by a bearing that holds the worm gear 30 in operative contact with the rack 29. A cable assembly (FIG. 2) includes a sleeve 80 attached to the hat-shaped channel 28 and the inner telescoping/rotatable cable 43 attached to the worm gear 30 for driving the worm gear 30. The ratio of a rotation of the worm gear 30 to movement along the rack 29 can be varied by design for specific applications, but it is contemplated that a ratio will be chosen that prevents back driving of the worm gear 30 and that prevents backlash of the linear adjustment mechanism, but that allows quick adjustment. For example, it is contemplated that a ratio of about 5 to 1 will work satisfactorily.

The motor 40 (FIG. 5) is a reversible electric DC motor operable on a voltage and amperage as are presently used in modern vehicles, such as in a 12 volt circuit. For example, it is contemplated that a motor similar to that used in power-adjusted seat mechanisms will be used, although different motors and motivating devices are known that could be made to work. For reference, the illustrated motor used in early testing has a free rotational speed of about 650-rpm, and a loaded speed of about 400-rpm. The motor 40 is located in a convenient location where kinking and tight bending of the cables 43 and 44 are not a problem. The illustrated motor 40 (FIG. 1) is mounted to a side of the wall section 53 at a location where it is relatively close to the racks 29 and 37 and where cables 43 and 44 can be extended to the racks 29 and 37 without kinking in all of the adjusted positions of the subassemblies 22 and 23. The motor 40 includes a rotatable shaft 41 and a driving gear 42 on an end of the shaft 41. A gear housing 84 (FIG. 5) is mounted to an end of the motor 40 and includes a pair of cavities for the driven gears engaging the driving gear 42. The driven gears are attached to one end of the cables 43 and 44 (FIG. 1), such that when the shaft 41 of motor 40 is rotated, the cables 43 and 44 are simultaneously rotated. The other ends of the cables 43 and 44 are connected to worm gears 30 and 38 so that, as the cables 43 and 44 are rotated, the subassemblies 22 and 23 are simultaneously linearly adjusted an equal amount. The equal and simultaneous adjustment is believed to be very important so that the pedals 25 and 33 remain in similar relative locations, so that a vehicle driver does not "mis-hit" one of the pedals 25 or 33 when moving his/her foot from one pedal to the other (i.e., simultaneous and equal adjustment tends to reduce any potential for problems and driver confusion during "cross-over" operation of the pedals.)

To adjust the brake pedal subassembly, the motor 40 is actuated, and the worm gear 30 rotated until a desired adjusted position is achieved. To use the brake pedal, the vehicle driver presses on the foot pedal pad 66, and the entire brake pedal subassembly 22 (including the upper and lower portions 24 and 25) rotate as a unit, thus pushing the push rod to operate the master brake cylinder of the vehicle brake system.

The accelerator pedal subassembly 23 (FIG. 5) includes an accelerator pedal upper portion 32 and an accelerator pedal lower portion 33 slidably secured to the upper portion 32, in a manner that is similar to that of the brake pedal subassembly 22. Specifically, the upper portion 32 includes a top bracket 90 pivoted to the support 21 by a pivot pin 91 and a connector 89 for connection to a throttle control actuator push rod 90 (FIG. 5) of the vehicle engine. The lower portion 33 includes a structural arm 92, an accelerator foot pedal pad 93 on a lower end of the arm 92, and an upper bracket 94. The linear adjustment mechanism 34 includes a C-shaped channel 35 (sometimes called a "guide" herein) defining a track and a follower 36 having edges defining a blade shape for linearly slidably engaging the channel 36. The rack 37 is attached to the channel 35, and the worm gear 38 is attached to the follower 36 in operative engagement with the rack 37. The cable 44 is secured to the worm gear 38, and extends to a driven gear of the transmission on the motor 40. The arrangement of the accelerator pedal subassembly 23 is not unlike brake pedal subassembly 22. A device can be attached to pivot pin 91 to help hold the accelerator pedal subassembly 23 in a selected pivoted position to reduce stress on a driver's foot when operating the vehicle. The device 98 provides a hysteresis effect that helps hold a selected position, but allows the accelerator pedal subassembly 23 to return to a "gas-off" position when released by the driver.

Notably, the linear adjustment devices 26 and 34 are positioned high relative to the associated respective pivot pins 55 and 91. In this "high" location, the linear adjustment devices 26 and 34 are tucked up under the instrument panel of the vehicle where they are partially shielded. This improves appearance and safety. The long vertical dimensions of the pedal arms 65 and 92 create substantial torque on the linear adjustment devices 26 and 34 (especially on brake pedal subassembly 22 during hard braking), but the elongated vertical dimension of the linear adjustment devices 26 and 34 provide the torsional resistance to prevent failure and excessive wear. Also, the relatively short horizontal/lateral dimension of the devices 26 and 34 maintain a small envelope, such that a minimum of space is required under the instrument panel to contain them. The elongated vertical dimension of the linear adjustment devices 26 and 34 are typically in the range of 15 to 200 mm, preferably in the range of 25 to 100 mm, and most preferably in the range of 30 to 60 mm.

It is noted that the track 27 can be oriented horizontally or at an angle to horizontal, depending on the vehicle manufacturer's specifications and/or vehicle constraints. In some cases, a horizontal position is most desirable (such as for an accelerator pedal). A non-vertical orientation could provide maximum resistance to force in both a fore-aft application of the pedal and a side-to-side load on the pedal, and also to help facilitate packaging the pedal assembly in the vehicle. The long dimension of the elongated dimension of the linear adjustment device could be positioned in the range of 0 degrees (vertical) to 90 degrees (horizontal), preferably in the range of 0 degrees to 45 degrees, more preferably in the range of 0 degrees to 15 degrees, and most preferably designed vertically.

First Modification

Figure 11:
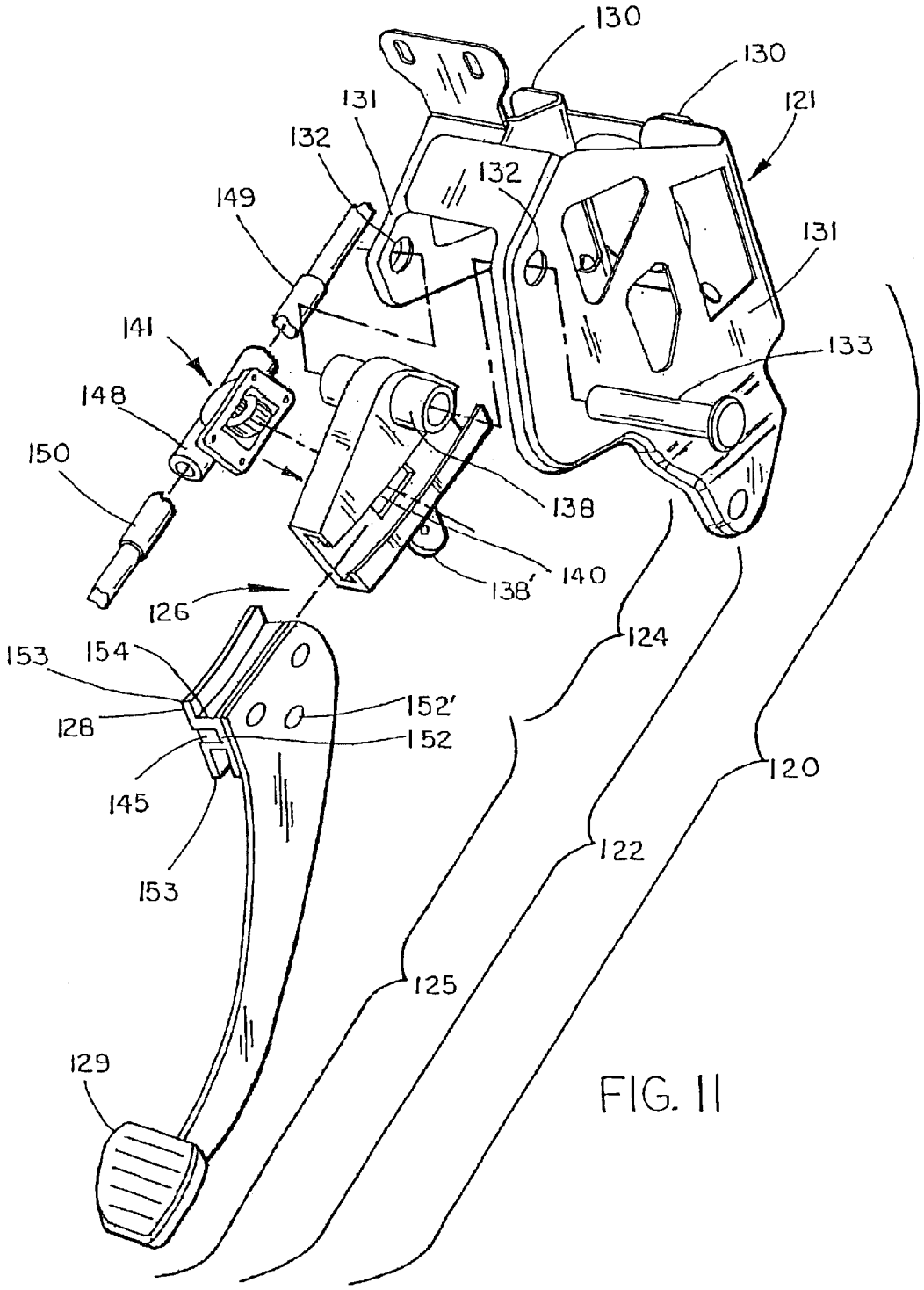
FIG. 11 is an exploded perspective view of an adjustable pedal apparatus embodying the present invention.
Figure 12:
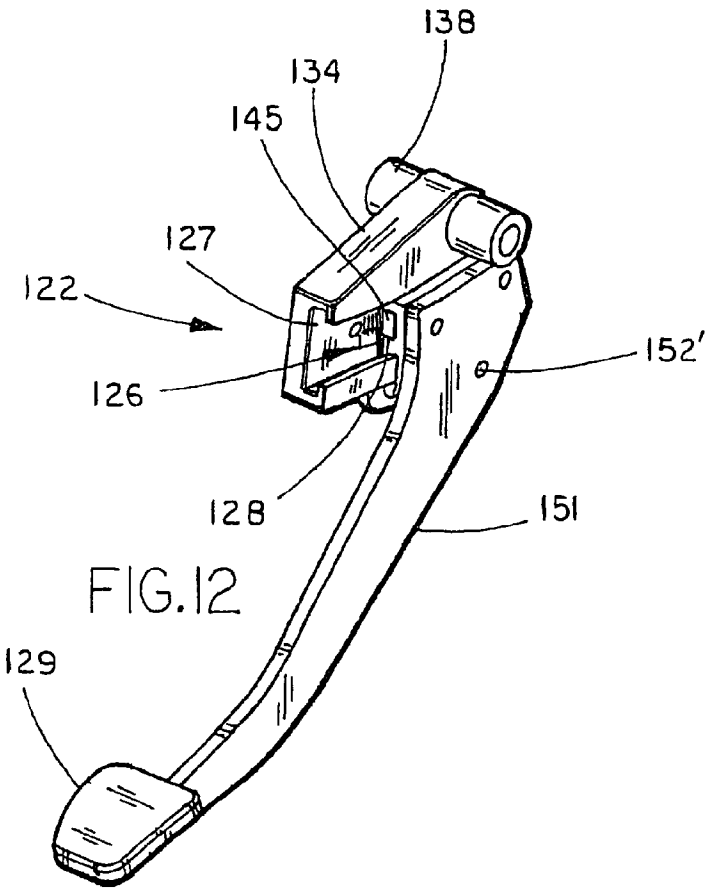
FIGS. 12 and 13 are perspective views of the brake pedal subassembly shown in FIG. 11.
Figure 13:
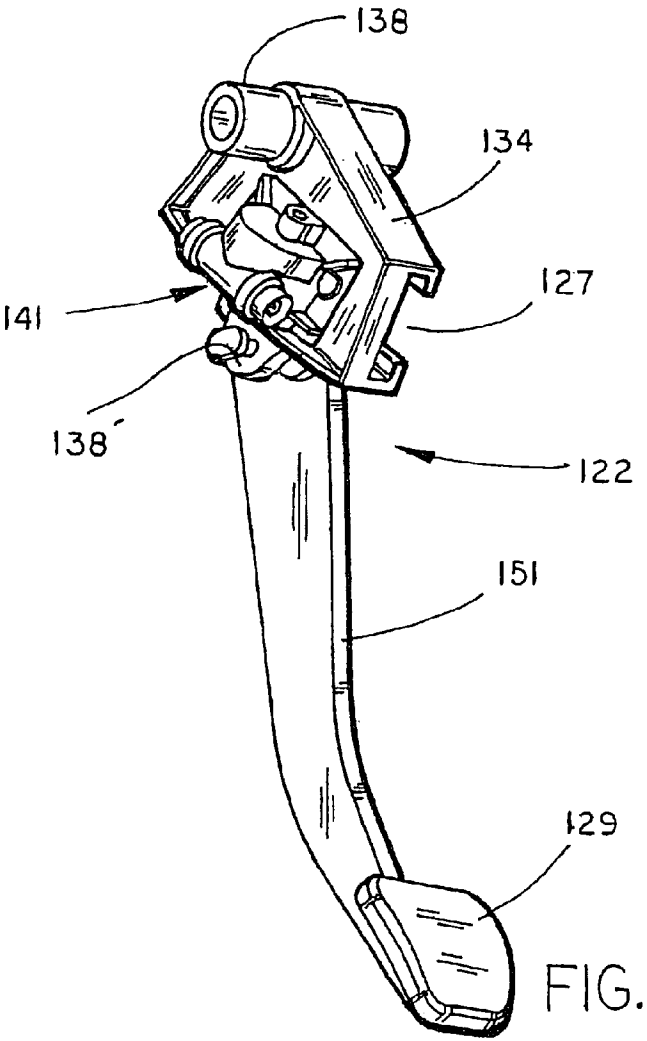

A modified pedal-supporting apparatus 120 (FIG. 11) includes a bracket support 121 configured for attachment to a vehicle firewall under the vehicle's instrument panel, and a brake pedal subassembly 122 (FIG. 12) pivoted to the support 121. Though a brake pedal subassembly is illustrated, it is contemplated that the present invention could be used on any vehicle pedal system. The brake pedal subassembly 122 includes an upper portion 124 pivotally engaging the support 121 (FIG. 11), and a lever portion 125 coupled to the upper portion 124 by an adjustment device 126. The adjustment device 126 includes a longitudinally curved track or channel 127 attached to the upper portion 124, and a hat-shaped follower 128 on the lever portion 125. The follower 128 includes blade-shaped curved edges operably engaging the track 127. The curved track 127 defines an arcuate path particularly shaped to cause the lever portion 125 to pivot about a virtual pivot strategically located well above the adjustment device 126, such that the brake pedal pad 129 moves along a predetermined path that optimally positions the pedal pad 129 for large-bodied vehicle drivers (when in a far-from-the-driver, forwardly-adjusted position) and for small-bodied vehicle drivers (when in a close-to-the-driver, rearwardly-adjusted position). The arcuate track 127 results in a shorter track, since the movement of the pedal pad is magnified over the movement of the follower 128. By this arrangement, the total volumetric package size of the adjustment device 126 and also of the upper portion 124 is considerably smaller than adjustable pedal systems where the track is linear, since less travel of the adjustment device itself is needed. This also results in substantial advantages in terms of a more compact assembly, smaller parts, reduced weight, and a safety improvement in terms of less elongated protruding components under a vehicle dash. At the same time, the curved track defines a virtual pivot instead of an actual pivot, which has advantages, since the curved track can be located at a lower position without requiring structure at the location of the virtual pivot.

The bracket support 121 (FIG. 11) includes apertured flanges 130 for attachment to a vehicle firewall. The support 121 further includes sidewalls 131 optimally designed for strength and light weight. Holes 132 are provided in sidewalls 131 for receiving a pivot pin 133. The sidewalls 131 are constructed with bends, apertures, and reinforcement ribs to provide optimal strength and low weight. It is noted that support 121 can be a stamped metal part, a die-cast part, or a molded plastic component.

Figure 14:
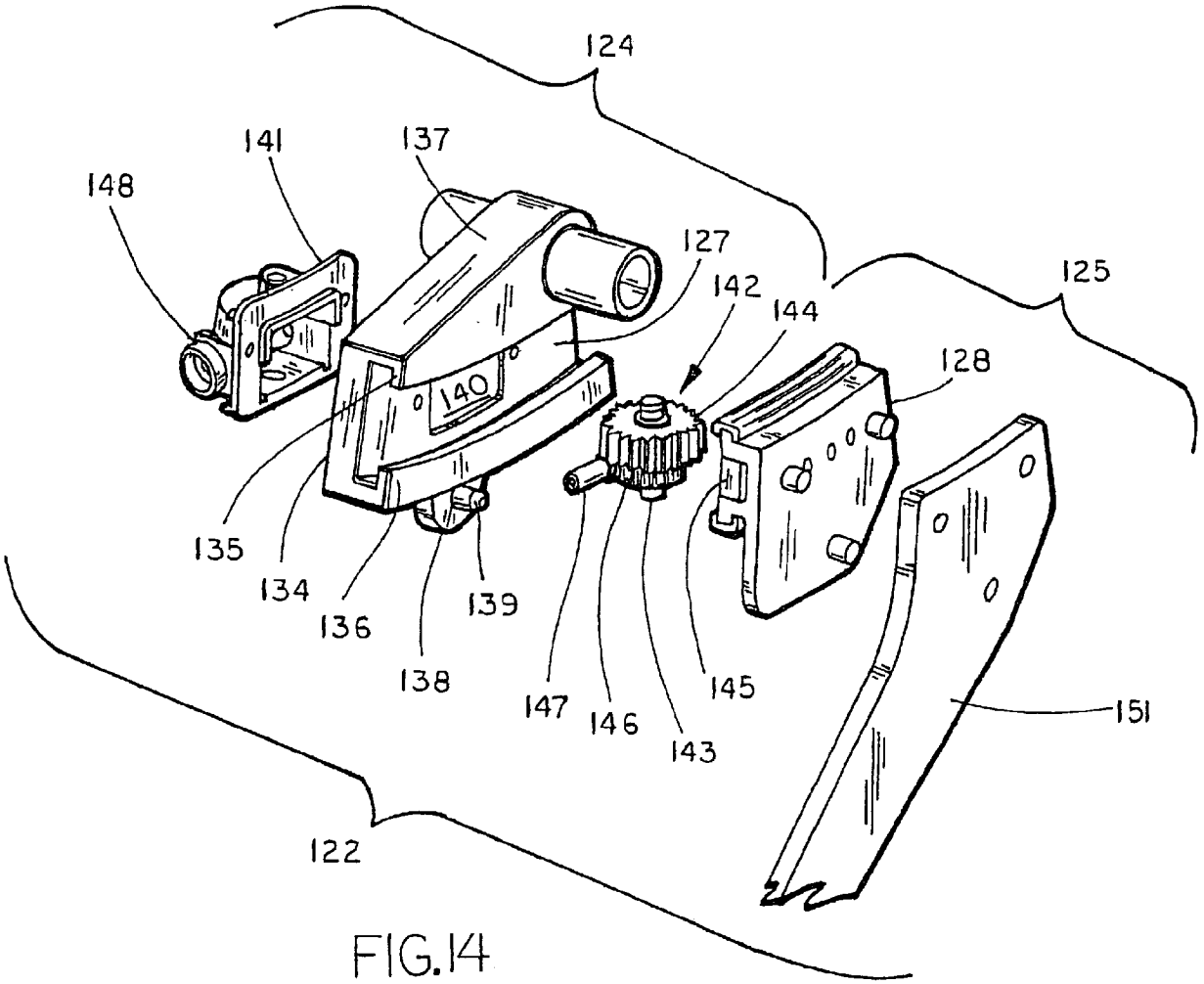
FIGS. 14 and 15 are exploded perspective views of the pedal subassembly shown in FIGS. 12 and 13, respectively.
Figure 15:
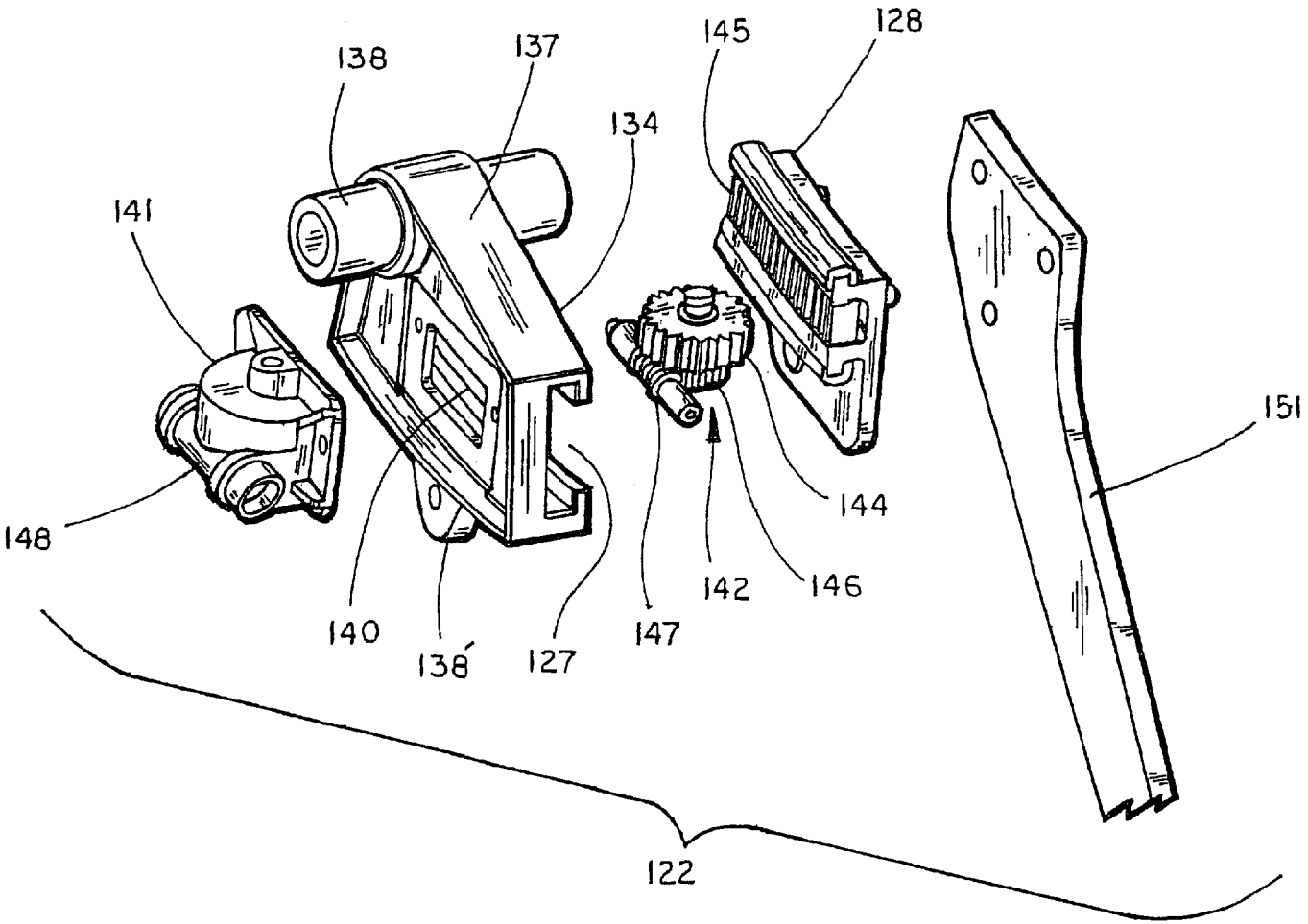
Figure 16:
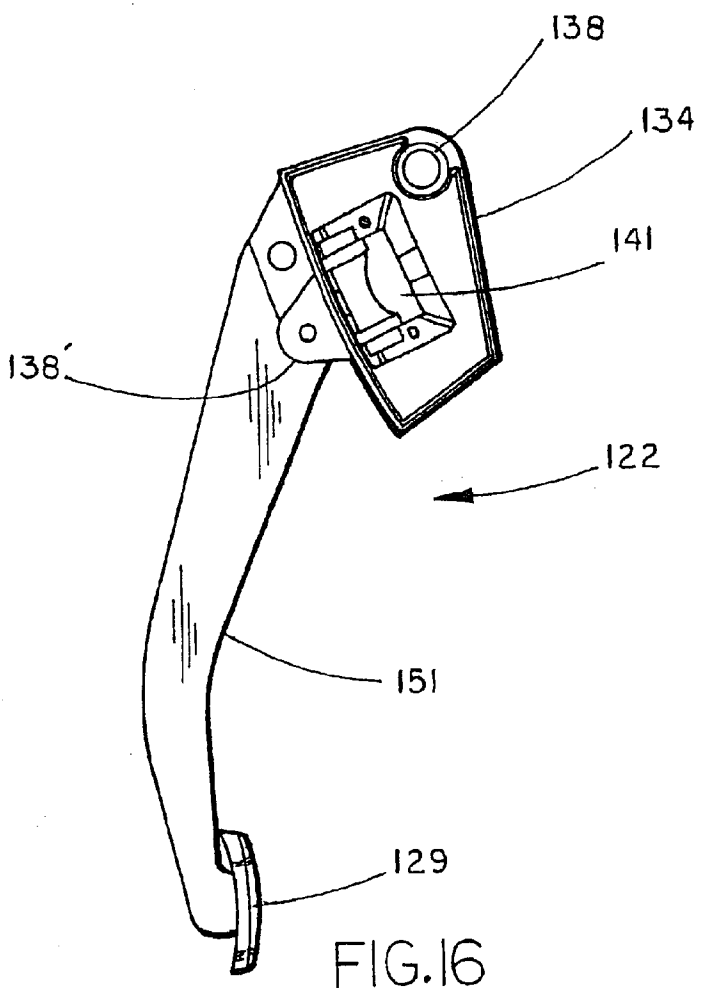
FIGS. 16 and 17 are side views of the accelerator pedal subassembly shown in FIG. 12.
Figure 17:
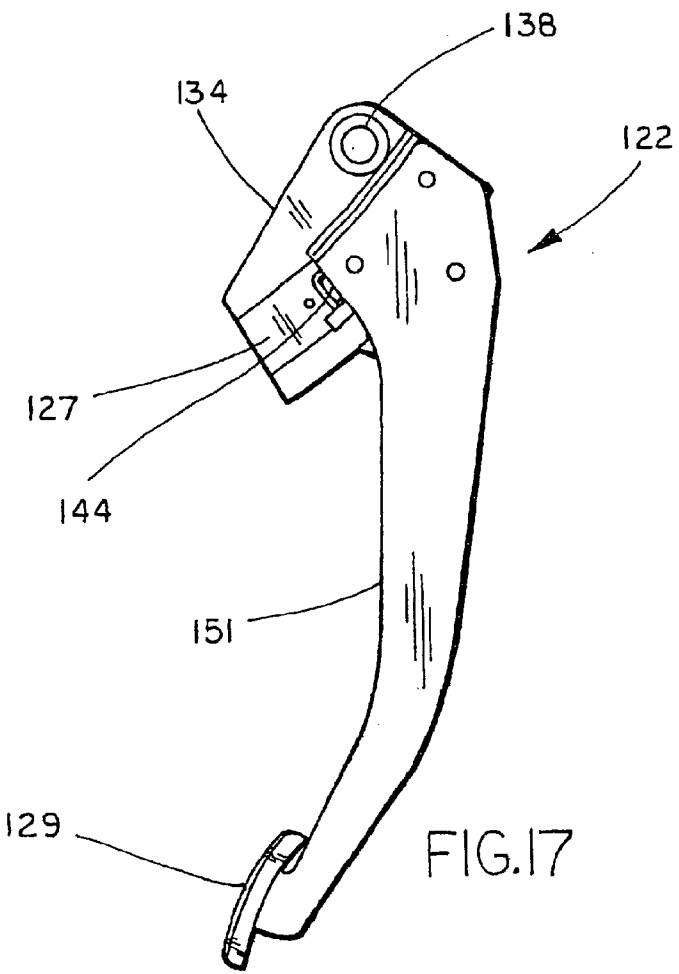

The upper portion 124 (FIG. 14) of the subassembly 122 includes a body 134 with L-shaped arcuate flanges 135 and 136 on one side defining the track 127 between them. A top section 137 of the body 134 extends above the top flange 135 supports a transverse cylindrical section 138 for receiving pivot pin 133. The cylindrical section 138 has a length chosen to fill the space between the sidewalls 131 (FIG. 11), and has a diameter to closely but rotatably receive the pivot pin 133.

A flange 138 (FIG. 14) extends downwardly from the body 134 and includes a connector 139 for connection to a push rod such as for operating a master brake cylinder of a vehicle braking system. Such push rods are well known in the art, and need not be described in detail herein for an understanding by a person skilled in this art.

An opening 140 is cut through body 134 at a location generally in the longitudinal center of the track 127. A housing 141 is screw-attached to a side of the body 134 opposite the flanges 135 and 136. A gear member 142 is positioned in the housing 141 and rotatably supported by an axle 143. The gear member 142 includes a first drive gear 144 that extends through the opening 140 and is operably engaged with a rack 145 in the follower 128 as described below, and includes a second gear 146 positioned beside the first gear 144 and also supported on the axle 143. A worm gear 147 is rotatably supported in the housing 141 by cylindrical section 148 at a 90-degree orientation from the axis of the second gear 146 and operably engages the second gear 146. A motor-driven cable 149 (FIG. 11) is attached to the worm gear 147 and is attached to a rotatable shaft of a DC reversible electric motor, such as are sometimes used in vehicles. When the motor is rotated, the worm gear 147 engages the second gear 146, causing the first gear 144 to rotate, engage the rack 145, and move the follower 128 along the track 127.

The worm gear 147 includes an exposed tail end configured to be engaged by a second cable 150, such that the second cable 150 is rotated at the same time and in the same direction as the first cable 149 when the motor is operated. It is contemplated that the second cable 150 can be extended to a second adjustable pedal apparatus similar to apparatus 120. By this means, multiple adjustable pedal apparatus can be simultaneously adjusted.

The lever portion 125 includes a lever 151 attached to the hat-shaped follower 128 by rivets 152 (or by welding or other means). The pedal pad 129 is attached to a lower end of the lever 151. The follower 128 is hat-shaped, and includes a center wall 152, arcuate edge flanges 153 that mateably slidably engage the recesses formed under the L-shaped flanges 135 and 136, and transverse walls 154 that connect the edge flanges 153 to the center wall 152. Plastic bearing caps (see FIG. 14) and lubricant can be used on flanges 135 and 136 to reduce friction and provide uniform sliding movement, but it is noted that some frictional resistance is desired to help prevent undesired adjustment movement.

To adjust the pedal subassembly, the motor is operated to rotate cable 149 and in turn rotate gears 147 and 144 of gear member 142, thus moving follower 128 and lever portion 125 along the arcuate track 127. To use the brake pedal, the vehicle driver presses on the pedal pad 129, causing the lever portion 125 and the upper portion 123 to pivot as a unit about pivot pin 133, thus pushing the push rod toward the master brake cylinder.

Figure 18:
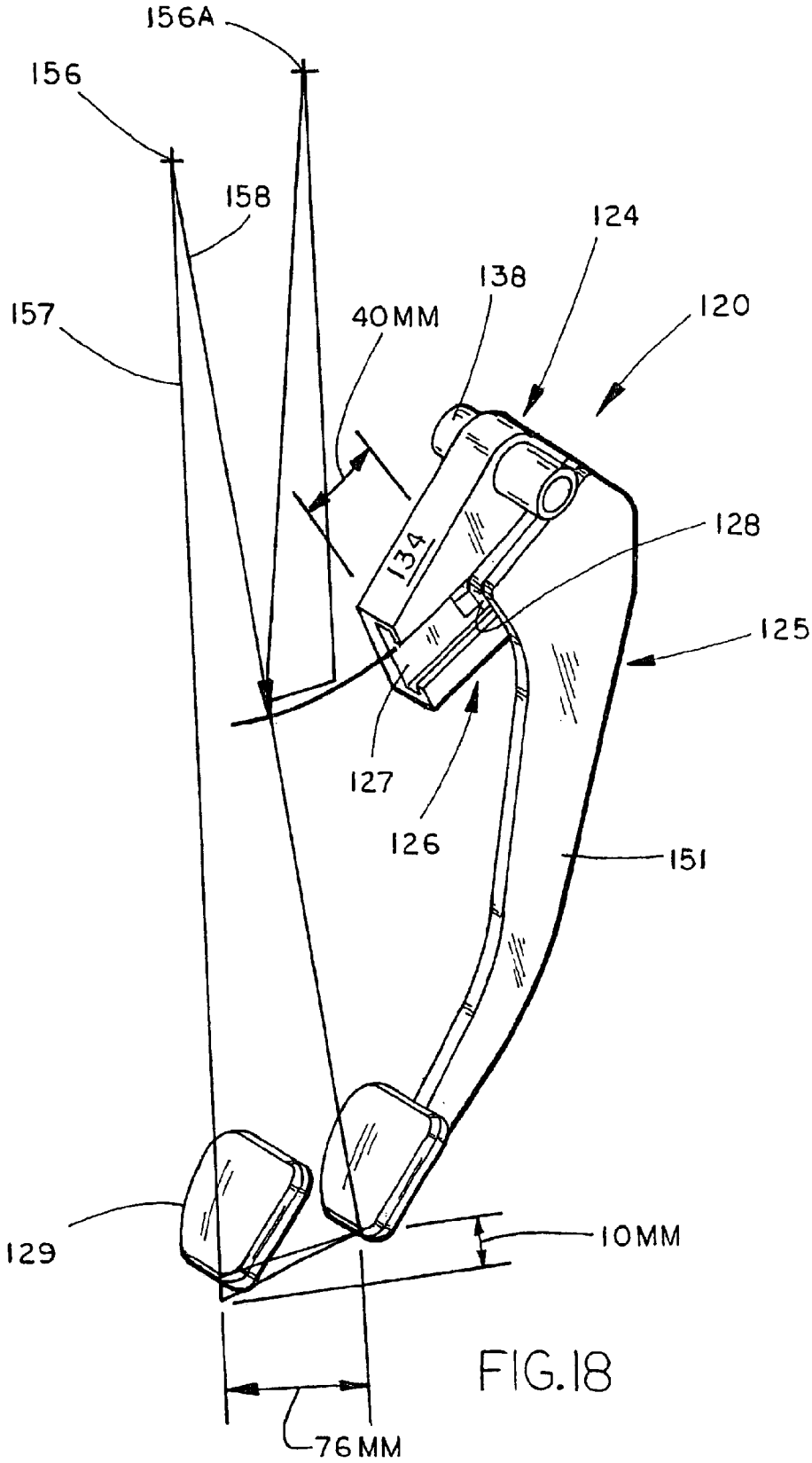
FIG. 18 is a perspective view of the brake pedal subassembly shown in FIG. 12, but showing a path of the pedal during adjustment about a first virtual pivot point.

Notably, the curved adjustment device 126 (FIG. 18) (i.e. track 127 and follower 128) defines a virtual pivot 156 that is substantially above the track 127. The chordal length of track will typically be in the range of 75 to 150 mm, preferably in the range of 100 to 125 mm. The follower length will typically be in the range of 50 to 100 mm, preferably in the range of 50 to 75 mm. Typically, the ratio of chordal length of track to the follower length is in the range of 1.2 to 2.5, preferably in the range of 1.4 to 2.25, and most preferably in the range of 1.5 to 2.0. As illustrated, the radius 157 that extends between the virtual pivot 156 and the pedal pad 129 is about 565 mm, and the radius 158 to a centerline on the track 127 is about 326 mm. Also, the virtual pivot 156 is located rearward (i.e. toward the vehicle driver) from the adjustment device 126. As a result, when the follower 128 moves 40 mm in an arcuate forward direction (toward a vehicle driver), the pedal pad 129 moves along a predetermined arcuate path that is 76 mm toward the vehicle driver and 10 mm lower. This results in an optimal position, according to the specifications of one vehicle manufacturer, of the pedal pad 129 relative to the vehicle floor pan, both when the pedal pad 129 is adjusted to its forward position 159 (optimal for large-bodied persons) and when adjusted to its rearward position 160 (optimal for small-bodied persons).

It is to be understood that different virtual pivot points can be designed into the present device. For example, the virtual pivot 156A illustrates a second location directly above the track 127, which results in the pedal pad 129 moving through an arcuate path segment of about 76 mm where the front and rear positions of the pedal pad 129 are about equal in height. Thus, different vehicle manufacturer specifications can be easily met. Importantly, the chordal longitudinal length of edge flanges 153 of the follower 128 and their engagement with the L-shaped flanges 135 and 136 results in a mechanically advantageous arrangement capable of withstanding substantial torques. This is important because at least one manufacturer specifies that the pedal construction must withstand 300 pounds of force at the brake pad 129. Translating this force through the long torque arm of lever portion 125 to pivot pin 133 and back to the track 127 results in over 2000 pounds of force on the flanges 135 and 136. Thus, length of engagement by the edge flanges 153 on the L-shaped flanges 135 and 136 is important for sufficient torsional strength. In the present arrangement, a chordal length of track 127 that is about 117 mm and a follower length that is about 70 mm provides the necessary strength while still meeting the small volumetric size requirements of most vehicle manufacturers for this device. This compares to a linear track that would have to be about 160-mm or longer in order to provide similar pedal travel.

As noted above, in one aspect, the present invention comprises a new type of adjustable pedal assembly, which includes a virtual pivot. This system includes the best features and benefits of both a pivoting system and a linear travel system. In a virtual pivot system, the fore-aft movement of the pedal is accomplished by a combination of fore-aft travel and radial travel where the radial travel approximates linear travel due to the large virtual radius. It is desirable to design a virtual pivot system where the distance from the pedal to the virtual pivot (virtual radius), is approximately 1.7 times the distance from the centerline of the track to the virtual pivot, or a ratio of 1.7:1. Other ratios are also possible but typically in the range of 1.3:1 to 3:5, preferably in the range of 1.5:1 to 2.5:1, and most preferably in the range of 1.5:1 to 2.0:1. A virtual pivot system will typically have a virtual radius in the range of about 350–800 mm., preferably in the range of 400–700 mm and most preferably in the range of 500–600 mm for most automotive applications. When a virtual pivot system is designed with a 1.73:1 ratio including a virtual radius of 565 mm and a distance of virtual radius to centerline of the track of 326 mm, the assembly can be configured so that there is little change in vertical pedal position as the pedal is adjusted from its full forward to it's full rearward position of approximately 76 mm (similar to FIG. 18, but with zero vertical change). This gives the vehicle designers great flexibility in designing a system to precisely position the pedal in the optimal location in both the full forward and full rearward pedal positions, and to accommodate or package the relatively small virtual pivot pedal adjustment mechanism into very tight spaces under the vehicle dash.

Notably, A system with a virtual pivot is not limited to a system with a C-shaped track. Other configurations are possible. One such configuration is a curved track defined by a curved shaft or rod with a follower defined by a collar that slides over the shaft forward and rearward when driven by a motor and drive gears. Additionally, the collar could be internal of the shaft and slide within the shaft when driven by a motor and drive gears.

Second Modification

Figure 19:
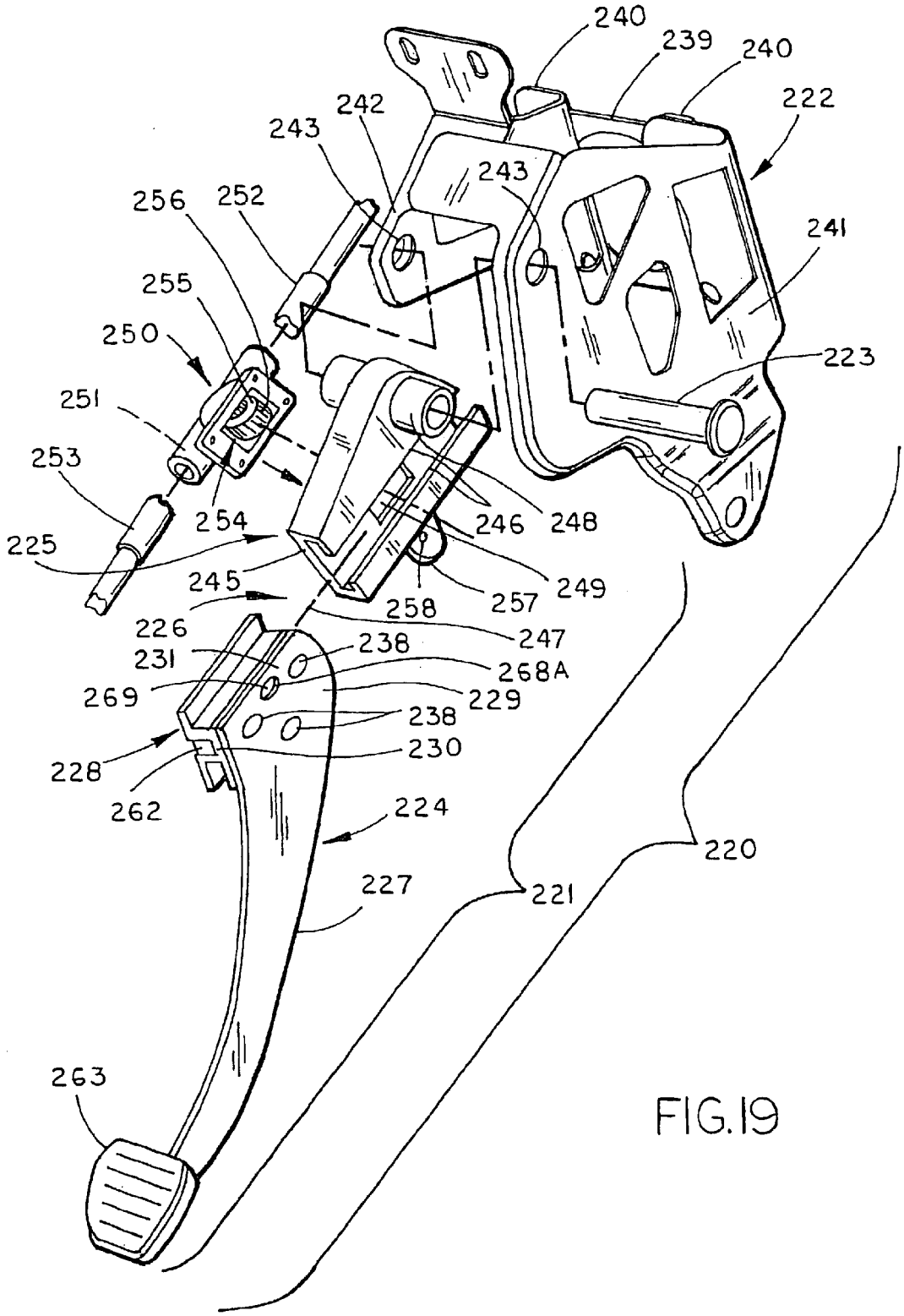
FIG. 19 is an exploded perspective view of a pedal construction embodying the present invention.

A further modified pedal construction 220 (FIG. 19) includes an adjustable pedal subassembly 221 pivoted to a bracket support 222 by a pivot pin 223. The pedal subassembly 221 has a lower pedal member 224 adjustably supported on an upper pedal member 225 by an adjustment device 226. The lower pedal member 224 includes a pedal lever 227 and a lever mount 228 including abutting mounting sections 229 and 230 forming a torsionally-strong fixed joint 231. Specifically, the mounting section 230 of the lever mount 228 has a channel 232 with sharp edges 233 and the mounting section 229 of the pedal lever 227 has a ridge 234 interference fit into the channel 232. The sharp edges 233 shave marginal material 235 from sides 236 of the ridge 234 when the ridge 234 is forced into the channel 232. The ridge 234 has depressions 237 adjacent its bottom that receive the shaved marginal material 235 when the ridge 234 is forced into the channel 232, so that the marginal material 235 does not prevent a tight fit. Fasteners 238 extend through the ridge 234 and channel 232 to hold the joint 231 together, with the ridge 234 and channel 232 interface forming a primary mechanical structure providing torsional strength to the joint 231.

Bracket support 222 (FIG. 19) includes a bottom 239 with apertured attachment flanges 240 shaped to engage and be attached to a vehicle floor pan or firewall. Side flanges 241 and 242 extend from the bottom 239, and include aligned holes 243 shaped to receive pivot pin 223. The side flanges 241 and 242 are shaped to provide support to the pivot pin 223, and further include apertures to minimize weight.

The upper pedal member 225 (FIG. 19) includes a body 245 with two inward L-shaped flanges 246 defining a linear track along direction 247. A transverse pivot tube/spacer 248 extends from a top of the body 245, and is positioned to fit between the side flanges 241 and 242 and to receive the pivot pin 223. A window 249 is formed in the body 245, and a gear housing 250 is attached to a back of the body 245. A worm gear 251 is positioned in the housing 250, and includes a first end attached to a drive cable 252 (driven by a 12v DC motor for example) and a second end attached to a secondary driven cable 253 (such as for concurrently driving a second adjustable pedal arrangement). A gear member 254 is positioned in the housing 250, and includes a first gear 255 operably engaging the worm gear 251, and a second gear 256 that extends through the window 249. A down flange 257 extends downwardly from the body 245, and includes a connector 258 configured for connection to a push rod for operating a master brake cylinder when the brake pedal subassembly 221 is depressed.

Figure 20:
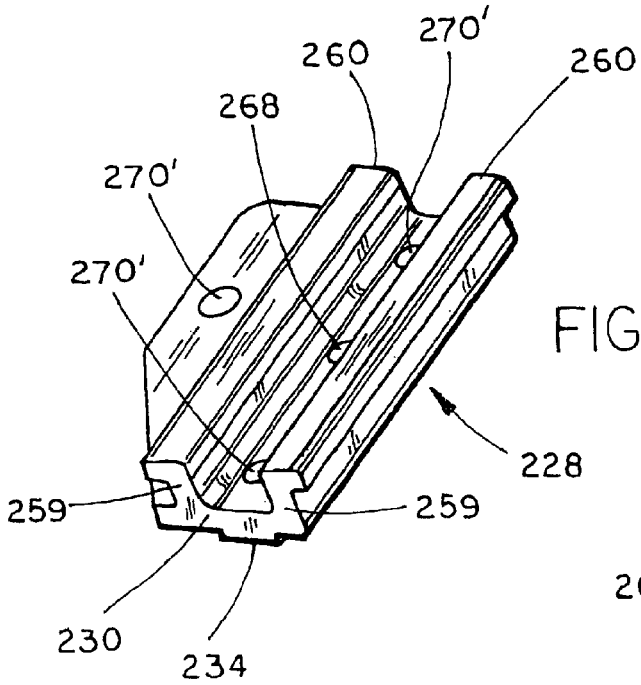
FIG. 20 is a perspective view of the lever mount shown in FIG. 19.
Figure 21:
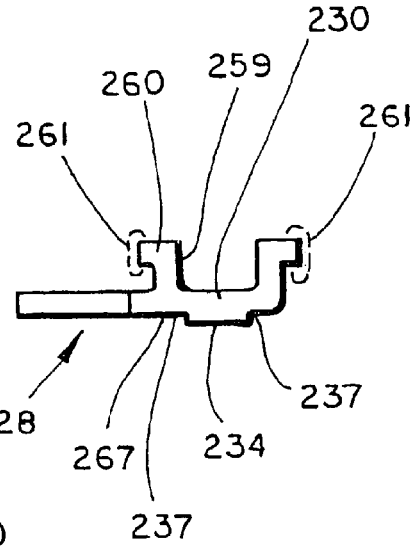
FIG. 21 is an end view of the lever mount of FIG. 20.

The lever mount 228 (FIG. 20) forms a hat-shaped follower configured to linearly slidably engage the track defined by "L" flanges 246. The mount 228 includes a center wall, which is flat and forms the mounting section 230, sidewalls 259, and outward walls 260. The outward walls 260 receive molded shoes or bushings 261 that slidably engage L-shaped flanges 246 on the member 225 for movement along direction 247. A rack 262 (FIG. 19) is attached between the sidewalls 259, and includes teeth 262 that operably mateably engage the teeth of the second gear 256, so that the lever mount 228 is moved along the track of body 245 as the gear member 254 is rotated.

Figure 22:
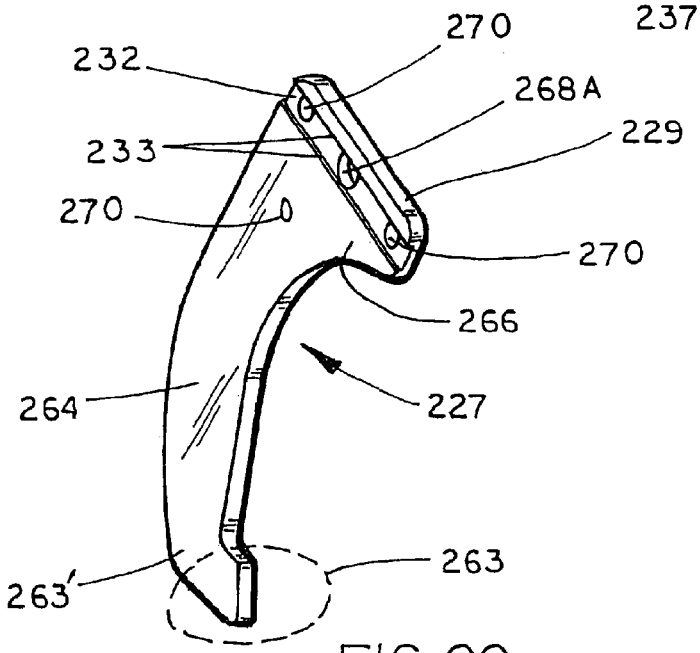
FIG. 22 is a perspective view of the pedal lever shown in FIG. 19.
Figure 23:
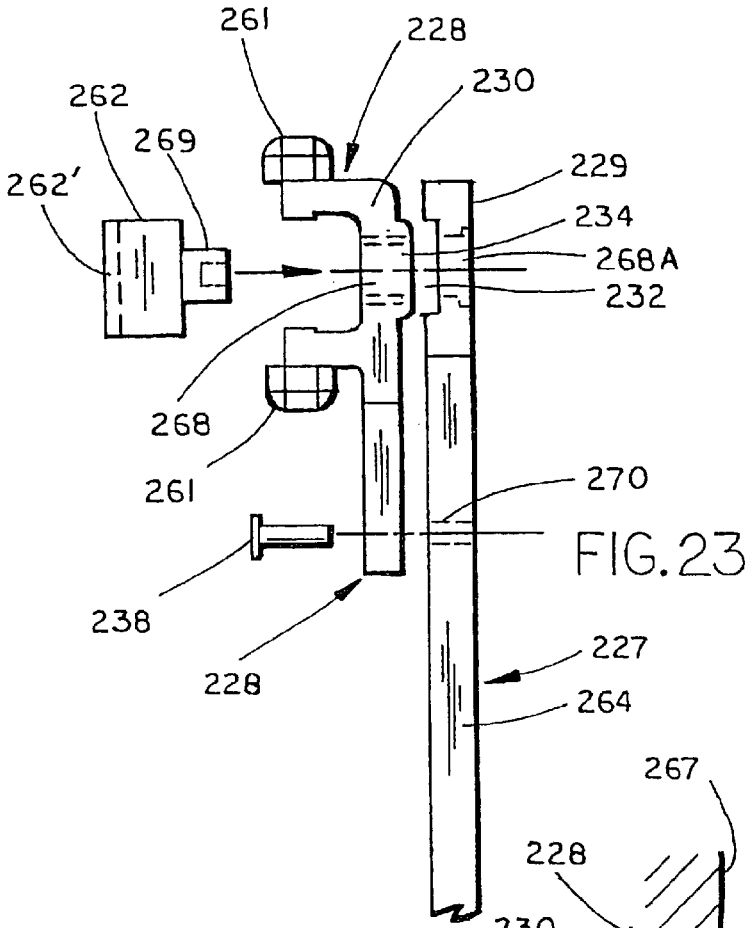
FIG. 23 is an exploded side view of the pedal lever attached to the lever mount.

The pedal lever 227 (FIG. 22) is vertically elongated, and includes a bottom end 263' supporting a foot pad 263, a mid-section 264 that is arch-shaped for optimally locating the foot pad 263 in a vehicle, and a top end forming the mounting section 229.

Figure 24:
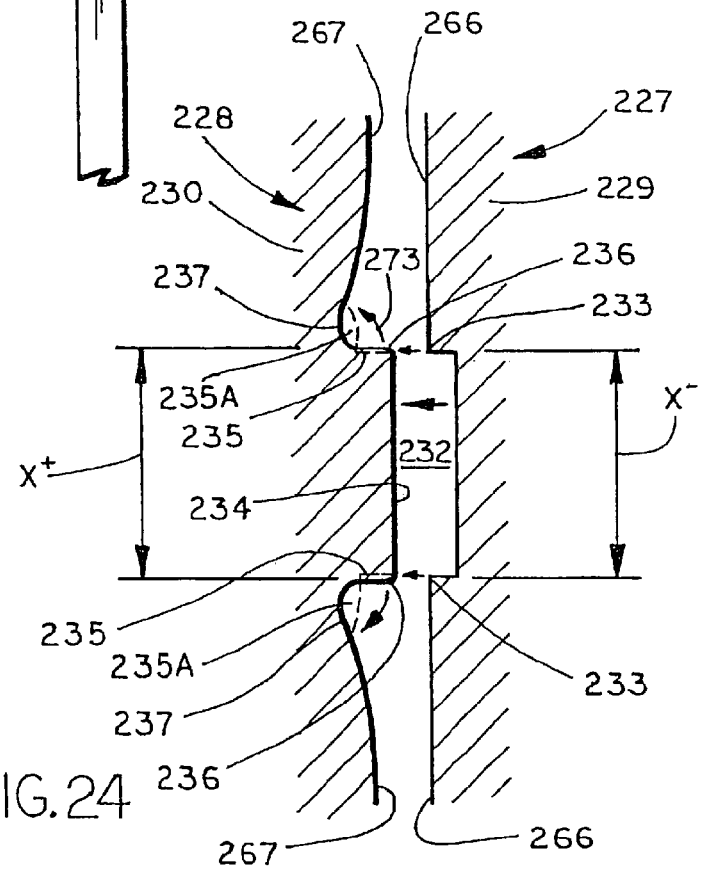
FIG. 24 is an enlarged exploded view of the ridge to channel interconnection.

The mounting sections 229 and 230 (FIG. 24) include flat surfaces 266 and 267, with the channel 232 and the ridge 234 being defined in the flat surfaces 266 and 267, respectively. (It is contemplated that the locations of the ridge and channel could be reversed on the mounting sections 229 and 230, if desired). Holes 268, 270, and 270' (FIG. 22) are formed in the mounting sections 229 and 230, such as in a center of the track of body 245, and rivets or locator pins are positioned in the holes as the mounting sections 229 and 230 are forced together, thus accurately locating and guiding the two mounting sections together. More specifically, three holes 270 and mating holes 270' are formed in the mounting sections 229 and 230, respectively, and rivets 238 or other fasteners are extended through the holes 270 and 270' for mechanically attaching the mounting sections 229 and 230 firmly together. Notably, the rivets 238 help hold the mounting sections 229 and 230 together in the direction of the rivets, but the ridge 234 and channel 232 interferingly engage to provide the primary torsional strength to the fixed joint 231, as described below. An enlarged clearance hole 268A (FIG. 20) is formed in the mounting section 230. A protrusion 269 on rack 262 is shaped to fit through hole 268, with the enlarged hole 268A providing access to peen over (i.e. the stake) the protrusion 269 to retain the rack 262 to the pre-assembled pedal construction 227/228.

The ridge 234 (FIG. 24) is slightly wider than the channel 232 and it includes the sharp edges 233. When the ridge 234 is pressed against and into the channel 232, the sharp edges 233 shave the marginal material 235 from the sides of the channel 232, causing the marginal material 235 to be shaved off and curl away in directions 273. The ridge 234 is about the same depth as the channel 232, such that when fully seated, a top of the ridge 234 presses the shaved marginal material 235A into the depressions 237. By this arrangement, the ridge 234 is consistently interferingly interlocked with the channel 232 with high torsional strength, even with normal manufacturing dimensional variations. The rivets 238 hold the fixed joint 231 together, but it is primarily the channel 232 and ridge 234 inter-fit that provides the torsional resistance to the joint 231. It has been found that by using the present arrangement, a very high-strength joint can be consistently constructed. Further, optimal and dissimilar materials can be used for the pedal lever 227 and the lever mount 228, while maintaining the needed functional strength required for a vehicle brake pedal assembly. For example, the illustrated brake pedal assembly can withstand over 200 pounds force on the footpad 263.

Figure 25:
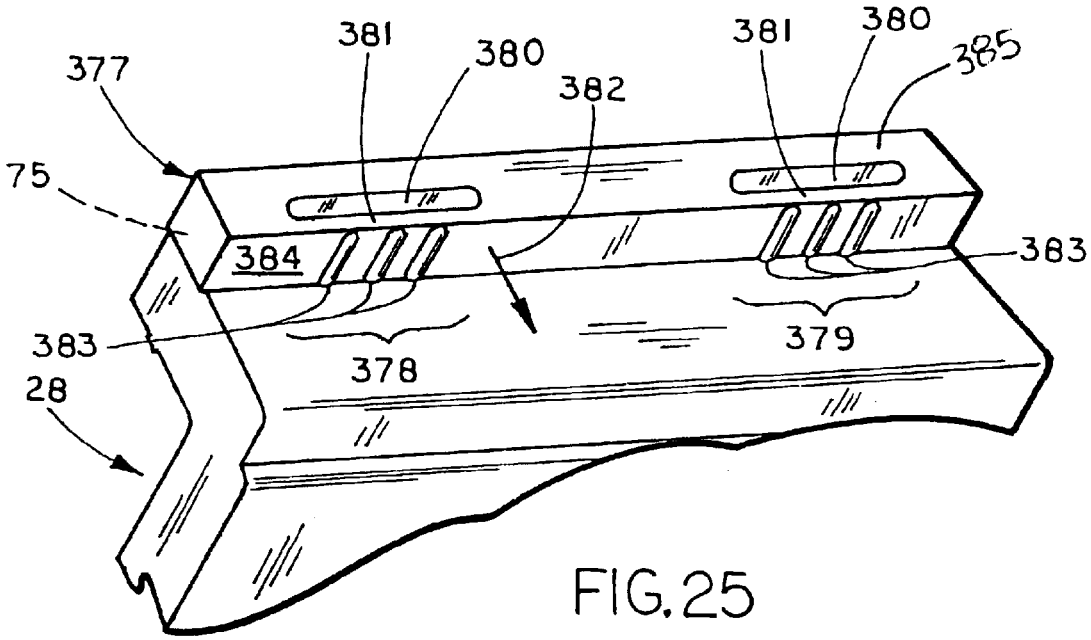
FIG. 25 is a fragmentary perspective view of a modified bearing shoe molded onto a flange of the follower.
Figure 26:
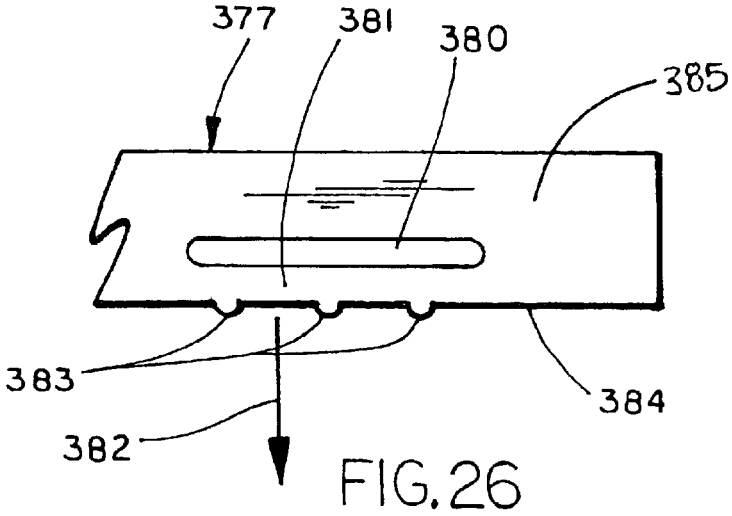
FIG. 26 is a top view of the bearing shoe in FIG. 25.

In FIGS. 25–26, the bat-shaped follower 28 is shown, but it is contemplated that the same inventive concepts could be incorporated into other track and follower constructions, such as follower 128 and/or follower 228. As noted above, lubricious bearing material, such as bearing material 77, is attached to the edge or flange 75 (and to the other edge 76) of the follower 28 for added long-term durability and for a constant coefficient of friction. Notably, some friction (e.g. a heightened level of static friction) is desirable to stabilize the linear adjustment mechanism in an adjusted position. The bearing material of FIG. 25 is in the form of a shoe 377 that provides this desired take-up of slack. The shoe 377 is molded onto (or otherwise attached to) the edge 75 and extends a length of the edge 75. The shoe 377 is a solid mass of material, such as nylon or other lubricious polymer, with the exception that it includes front and rear side flexible zones 378 and 379 forming resilient portions. The flexible zones 378 and 379 are identical, such that only the flexible zone 378 is described hereafter. A vertically-open relief slot 380 in the shoe 377 creates a flexible leaf-spring-like strip 381 having a desired level of stiffness in a sideways cross-car direction 382. Three (or more) vertically extending crush ribs 383 are formed on the side surface 384 of the strip 381. The crush ribs 383 are oval-shaped and extend into contact with the inside area of L-shaped portions of the track. The relief slots 380 allow the molded plastic strip 381 to deflect inward, yet always maintain frictional contact with the machined slots 225 in the track creating a controlled sliding force between the molded shoe and track of about 5 pounds force.

An important feature of the present adjustment mechanism is the amount of side-to-side lash that is allowable as measured at a bottom of the pedal (i.e. the amount of measured free-play in the cross-car direction). It is advantageous that there be a minimal amount of looseness in the pedal as to not give false information regarding the feedback the pedal gives to an operator. For this reason, free-play control is an important factor in operation of the pedal system. To achieve minimum lash in the pedal assembly, it is necessary to control the clearance between the plastic molded shoe and the machined slot in part 225. This is accomplished by the above-discussed arrangement, including the flexible portions 378, 379 with slots 380, flexible strips 381, and crush ribs 383.

In the foregoing description, those skilled in the art will readily appreciate that modifications may be made to the invention without departing from the concepts disclosed herein. Such modifications are to be considered as included in the following claims, unless these claims by their language expressly state otherwise.

The invention claimed includes:

1. An adjustable pedal apparatus comprising:

a support configured for attachment to a vehicle;

a pedal-supporting subassembly with an upper portion pivotally engaging the support, a lower portion supporting a pedal construction, and a track adjustment mechanism connecting the upper and lower portions, the track adjustment mechanism including a track defining at least one guide channel extending horizontally, and a follower slidably engaging the track, the follower including a bearing shoe made of bearing material that is located in and slidably engages the channel, the bearing shoe including a body and a resilient portion engaging the track, the resilient portion being flexed and at least partially compressed so that the bearing shoe takes up any slack and sloppiness between the track and follower;

an adjuster for adjusting the pedal construction along the track mechanism; and an actuator coupled to the pedal-supporting subassembly and adapted for operative connection to a control system of the vehicle for operating the control system when the pedal-supporting subassembly is moved;

wherein the at least one guide channel defines a path of movement, and wherein the bearing shoe is elongated parallel the path of movement.

2. The adjustable pedal apparatus defined in claim 1, wherein the resilient portion includes at least one band of material separated from a remaining portion of the bearing shoe and elongated in a direction parallel the path of movement.

3. The adjustable pedal apparatus defined in claim 1, wherein the resilient portion includes at least one band of material separated from a remaining portion of the bearing shoe and elongated in a direction parallel the path of movement.

4. The adjustable pedal apparatus defined in claim 3, wherein the resilient portion includes at least one crush rib.

5. The adjustable pedal apparatus defined in claim 1, wherein the resilient portion includes at least one cavity elongated in a direction parallel the path of movement.

6. An adjustable pedal apparatus comprising:

a support configured for attachment to a vehicle;

a pedal-supporting subassembly with an upper portion pivotally engaging the support, a lower portion supporting a pedal construction, and a track adjustment mechanism connecting the upper and lower portions, the track adjustment mechanism including a track defining at least one guide channel extending horizontally, and a follower slidably engaging the track, the follower including a bearing shoe made of bearing material that is located in and slidably engages the channel, the bearing shoe including a body and a resilient portion engaging the track, the resilient portion being flexed and at least partially compressed so that the bearing shoe takes up any slack and sloppiness between the track and follower;

an adjuster for adjusting the pedal construction along the track mechanism; and an actuator coupled to the pedal-supporting subassembly and adapted for operative connection to a control system of the vehicle for operating the control system when the pedal-supporting subassembly is moved;

wherein the at least one guide channel defines a path of movement and the resilient portion includes at least one cavity elongated in a direction parallel the path of movement.

7. An adjustable pedal apparatus comprising:

a support configured for attachment to a vehicle;

a pedal-supporting subassembly with an upper portion pivotally engaging the support, a lower portion supporting a pedal construction, and a track adjustment mechanism connecting the upper and lower portions, the track adjustment mechanism including a track defining at least one guide channel extending horizontally, and a follower slidably engaging the track, the follower including a bearing shoe made of bearing material that is located in and slidably engages the channel, the bearing shoe including a body and a resilient portion engaging the track, the resilient portion being flexed and at least partially compressed so that the bearing shoe takes up any slack and sloppiness between the track and follower;

an adjuster for adjusting the pedal construction along the track mechanism; and an actuator coupled to the pedal-supporting subassembly and adapted for operative connection to a control system of the vehicle for operating the control system when the pedal-supporting subassembly is moved, wherein the resilient portion includes at least one crush rib.

8. In an adjustable pedal apparatus that includes a pedal-supporting subassembly with an upper portion adapted to pivotally engage a support, a lower portion supporting a pedal construction, and a track adjustment mechanism connecting the upper and lower portions, the track adjustment mechanism including a track defining at least one guide channel, and a follower slidably engaging the track, an improvement comprising:

the follower including a bearing shoe made of bearing material that is located in and slidably engages the track, the bearing shoe including a body and a resilient portion engaging the track that is at least partially compressed toward the body so that the bearing shoe takes up any slack and sloppiness between the track and follower;

wherein the at least one guide channel defines a path of movement, and wherein the bearing shoe is elongated parallel the path of movement.

9. The adjustable pedal apparatus defined in claim 8, wherein the resilient portion includes at least one band of material separated from a remaining portion of the bearing shoe and elongated in a direction parallel the path of movement.

10. The adjustable pedal apparatus defined in claim 8, wherein the resilient portion includes at least one band of material separated from a remaining portion of the bearing shoe and elongated in a direction parallel the path of movement.

11. The adjustable pedal apparatus defined in claim 8, wherein the bearing shoe includes at least one cavity elongated in a direction parallel the path of movement.

12. The adjustable pedal apparatus defined in claim 11, wherein the resilient portion includes at least one crush rib.

13. In an adjustable pedal apparatus that includes a pedal-supporting subassembly with an upper portion adapted to pivotally engage a support, a lower portion supporting a pedal construction, and a track adjustment mechanism connecting the upper and lower portions, the track adjustment mechanism including a track defining at least one guide channel, and a follower slidably engaging the track, an improvement comprising:

the follower including a bearing shoe made of bearing material that is located in and slidably engages the track, the bearing shoe including a body and a resilient portion engaging the track that is at least partially compressed toward the body so that the bearing shoe takes up any slack and sloppiness between the track and follower;

wherein the at least one guide channel defines a path of movement and the resilient portion includes at least one cavity elongated in a direction parallel the path of movement.

14. In an adjustable pedal apparatus that includes a pedal-supporting subassembly with an upper portion adapted to pivotally engage a support, a lower portion supporting a pedal construction, and a track adjustment mechanism connecting the upper and lower portions, the track adjustment mechanism including a track defining at least one guide channel, and a follower slidably engaging the track, an improvement comprising:

the follower including a bearing shoe made of bearing material that is located in and slidably engages the track, the bearing shoe including a body and a resilient portion engaging the track that is at least partially compressed toward the body so that the bearing shoe takes up any slack and sloppiness between the track and follower, wherein the resilient portion includes at least one crush rib.

* * * * *